US009052135B2

(12) United States Patent
Trulaske, Sr.

(10) Patent No.: US 9,052,135 B2
(45) Date of Patent: Jun. 9, 2015

(54) REFRIGERATOR COOLER WITH MAGNETIC FRENCH DOOR GASKETS AND METHOD OF MANUFACTURE

(71) Applicant: True Manufacturing Company, Inc., O'Fallon, MO (US)

(72) Inventor: Steven L. Trulaske, Sr., St. Louis, MO (US)

(73) Assignee: TRUE MANUFACTURING COMPANY, INC., O'Fallon, MO (US)

( * ) Notice: Subject to any disclaimer, the term of this patent is extended or adjusted under 35 U.S.C. 154(b) by 0 days.

(21) Appl. No.: 13/972,353

(22) Filed: Aug. 21, 2013

(65) Prior Publication Data

US 2015/0054396 A1 Feb. 26, 2015

(51) Int. Cl.
*F25D 23/02* (2006.01)
*F25D 23/08* (2006.01)

(52) U.S. Cl.
CPC ..... *F25D 23/028* (2013.01); *F25D 23/087* (2013.01); *F25D 2323/021* (2013.01)

(58) Field of Classification Search
CPC ..... F25D 23/028; F25D 23/02; F25D 23/087; F25D 2323/021
USPC ..... 312/405, 324
See application file for complete search history.

(56) References Cited

U.S. PATENT DOCUMENTS

| | | | | | |
|---|---|---|---|---|---|
| 2,723,896 | A | * | 11/1955 | Wurtz | 312/296 |
| 3,248,159 | A | * | 4/1966 | Hall | 312/296 |
| 3,264,048 | A | | 8/1966 | Koch et al. | |
| 3,408,772 | A | * | 11/1968 | Frehse | 49/366 |
| 4,226,489 | A | * | 10/1980 | Haag | 312/296 |
| 4,288,135 | A | * | 9/1981 | Buchser et al. | 312/296 |
| 5,289,657 | A | | 3/1994 | Kiel | |
| 5,309,680 | A | * | 5/1994 | Kiel | 49/478.1 |
| 5,816,080 | A | * | 10/1998 | Jeziorowski | 62/441 |
| 5,975,664 | A | * | 11/1999 | Banicevic et al. | 312/405 |
| 7,823,331 | B2 | * | 11/2010 | Linkmeyer et al. | 49/478.1 |
| 2012/0262047 | A1 | * | 10/2012 | Stocker | 312/405 |

* cited by examiner

*Primary Examiner* — Daniel Rohrhoff
(74) *Attorney, Agent, or Firm* — Bryan Cave LLP

(57) ABSTRACT

A refrigerator cooler comprises a cabinet comprising at least one storage compartment having an open front and a front face. Refrigerator cooler further has left and right door assemblies rotatably affixed to the cabinet to close and seal against the front face when the left and right door assemblies are in a closed position. The left and right door assemblies comprise left and right doors, perimeter gaskets affixed to the back faces of the left and right doors, magnetic French door gaskets affixed to the inner faces of the left and right doors, and one or more door stops affixed to the left and right doors. The left and right magnetic French door gaskets are magnetically attracted to one another when the left and right doors are closed and are magnetically opposed one another when either the left or right doors are opened.

25 Claims, 31 Drawing Sheets

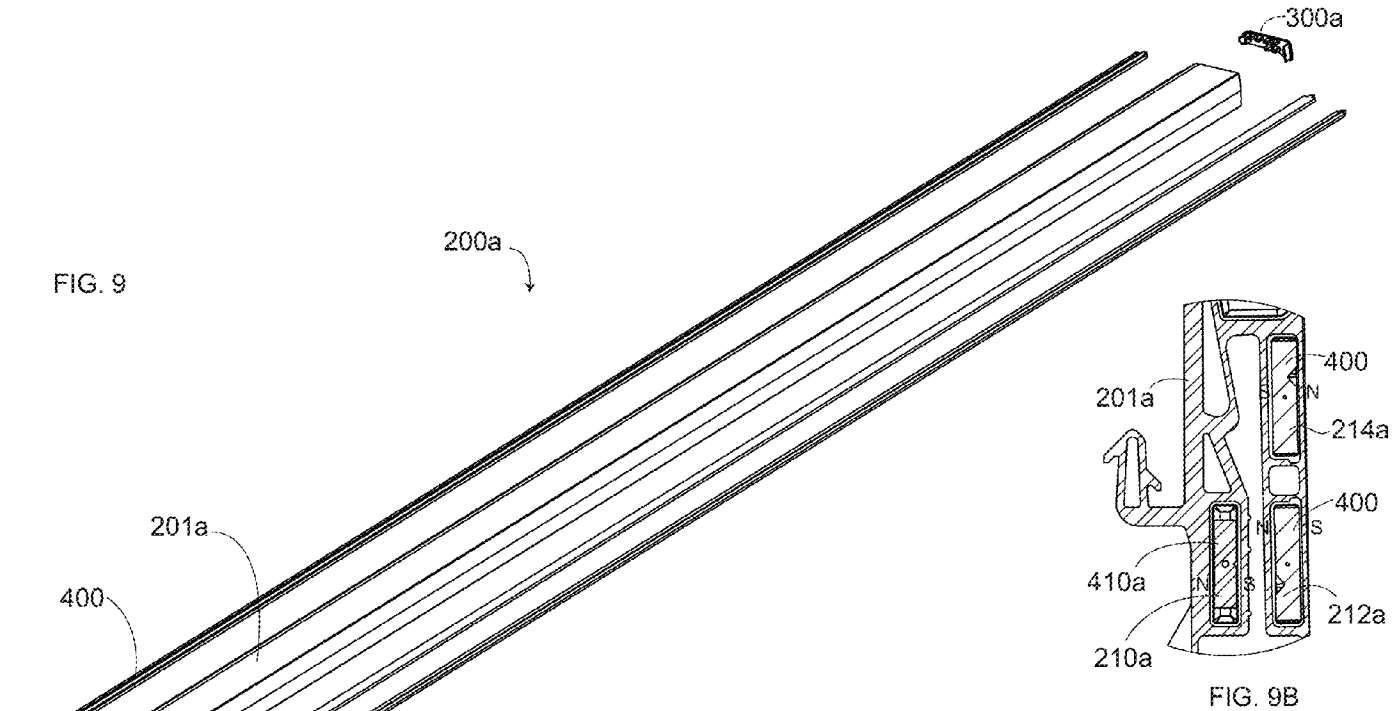
FIG. 9
FIG. 9B
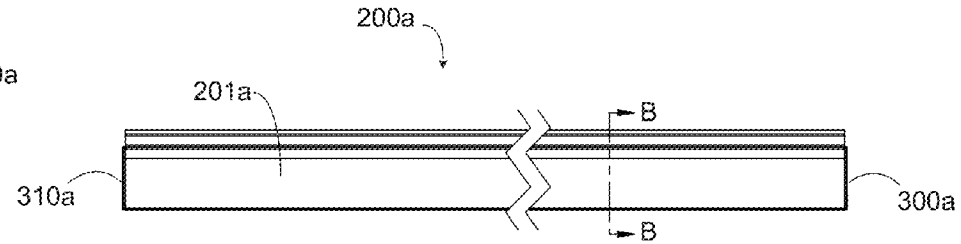
FIG. 9A

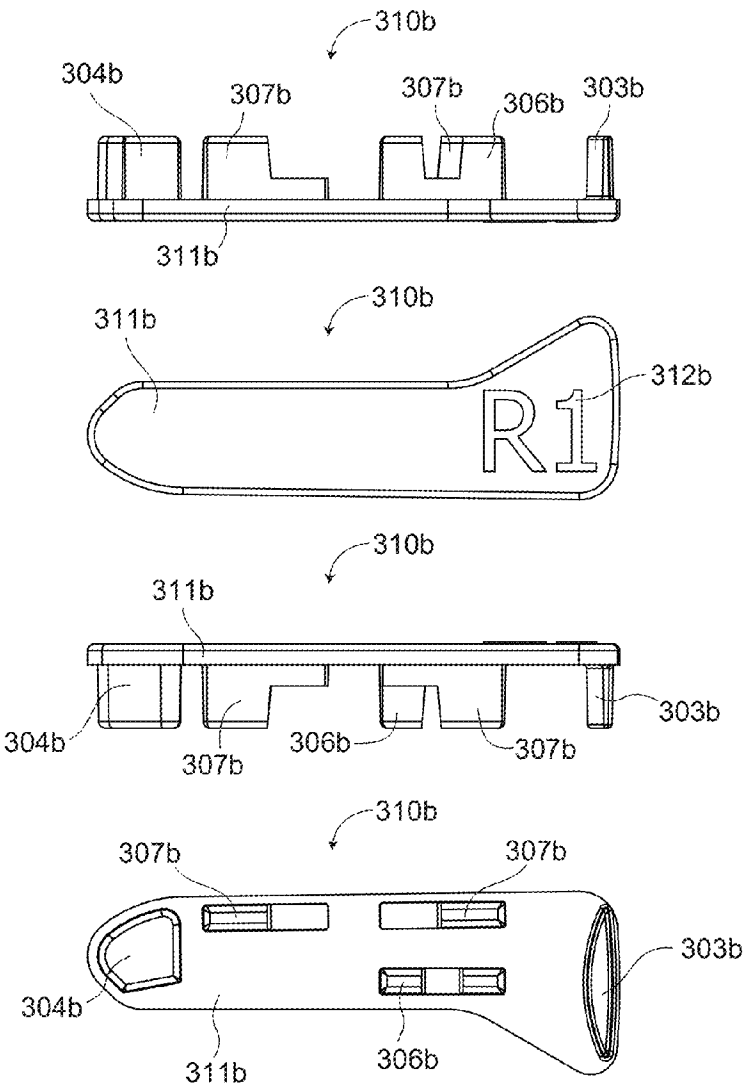
FIG. 17A
FIG. 17B
FIG. 17C
FIG. 17D
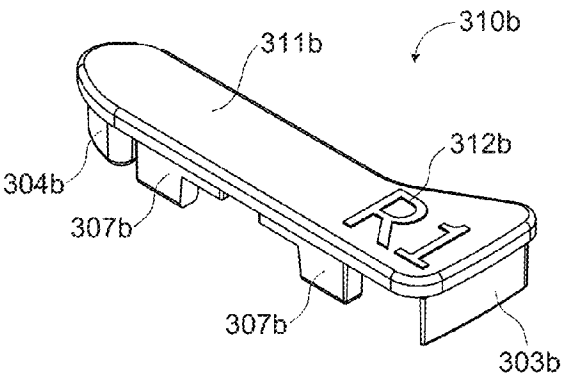
FIG. 17E

REFRIGERATOR COOLER WITH MAGNETIC FRENCH DOOR GASKETS AND METHOD OF MANUFACTURE

FIELD OF THE INVENTION

This invention relates generally to door seals for refrigerator coolers and, more particularly, to magnetic door seal assemblies for use in a side-by-side or French door style refrigerator cooler.

BACKGROUND OF THE INVENTION

Refrigerator coolers are used in a variety of places including supermarkets, gas stations, sports stadiums, offices, restaurants, coffee shops, etc. for stocking and displaying products for sale. Typically refrigerator coolers are stocked with beverages including soda, milk, beer, tea, sports drinks, energy drinks, etc. Refrigerator coolers often include a refrigeration unit and a thermally insulated cabinet in which the products for sale are kept cold. Refrigerator coolers may have a variety of types of door configurations including a single door hinged on one side of the refrigerator cooler or side-by-side doors wherein each door may be hinged along the edge of the refrigerator cooler in a French door configuration and may include a gasket assembly which releasably seals the cooler when the doors are closed. Typical French door configurations require a center vertical mullion against which the gasket assembly contacts to form a releasable seal. The vertical mullion and gasket assemblies assist in maintaining the low temperature in the refrigerator cooler. While the vertical mullion is beneficial for reducing heat transfer between the inside of the refrigerator cooler and the outside environment, it takes up valuable space inside a refrigerator cooler and impedes access to products directly behind it, particularly in a refrigerator cooler that is used to display products for sale.

Therefore, there is a need for an improved refrigerator cooler having a magnetic French door gasket which releasably seals and maintains the low temperature in the refrigerator cooler without the need for a vertical mullion. Preferably, the French doors of the improved refrigerator cooler include insulated glass panels that easily permit viewing of the products stored in the refrigerator cooler by consumers. If the size of the door frames of the French doors are reduced and the size of the insulated glass panels are increased, more products can be viewed by consumers. Furthermore, by eliminating the vertical mullion, additional space is made available inside the refrigerator cooler such that more products can be displayed for sale and accessibility to those products can be improved. Additionally, products stored inside an improved refrigerator cooler that does not have a vertical mullion are more visible by consumers, thereby potentially increasing sales of the products. In certain stores, the individual spaces in which the products are stored and displayed are sold to the product manufacturers, suppliers, distributors, etc., therefore the more viewable space that is made available inside a refrigerator cooler for products can result in additional revenue to the supermarkets, gas stations, sports stadiums, offices, restaurants, coffee shops, etc. from, not only the consumers who purchase the products, but also the manufacturers, suppliers, distributors, etc. who are purchasing the storage space in the refrigerator coolers.

SUMMARY OF THE INVENTION

One aspect of the present invention is directed to a refrigerator cooler having a cabinet with at least one storage compartment, wherein the compartment has an open front and is bounded by a vertical back wall, a horizontal bottom wall, a horizontal top wall, a vertical left side wall and a vertical right side wall. Preferably the bottom wall, the top wall, the left side wall and the right side wall form a cabinet front face. Refrigerator cooler preferably includes a left door assembly rotatably affixed to the cabinet to close and seal against the cabinet front face and a right door assembly rotatably affixed to the cabinet to close and seal against a portion of the cabinet front face when the left and right door assemblies are in a closed position. The left door assembly includes: (i) a substantially rectangular left door having a front face, a back face, an outer face, and an inner face; (ii) a left perimeter gasket affixed to the back face of the left door, wherein the left perimeter gasket comprises miter cut and sealed corners and wherein the left perimeter gasket contacts and seals against a portion of the front face when the left door is in a closed position; (iii) a left magnetic French door gasket affixed to the inner face of the left door, wherein the left magnetic French door gasket is separate from the left perimeter gasket; and (iv) one or more door stops affixed to the left door. The right door assembly includes: (i) a substantially rectangular right door having a front face, a back face, an outer face, and an inner face; (ii) a right perimeter gasket affixed to the back face of the right door, wherein the right perimeter gasket comprises miter cut and sealed corners and wherein the right perimeter gasket contacts and seals against a portion of the cabinet front face when the right door is in a closed position; (iii) a right magnetic French door gasket affixed to the inner face of the right door, wherein the right magnetic French door gasket is separate from the right perimeter gasket; and (iv) one or more door stops affixed to the door. The left and right magnetic French door gaskets are magnetically attracted to one another when the left and right doors are closed and are magnetically opposed one another when either the left or right doors are opened.

Another aspect of the present invention is directed to a method of installing left and right door assemblies on a cabinet having at least one storage compartment, wherein the compartment has an open front and is bounded by a vertical back wall, a horizontal bottom wall, a horizontal top wall, a vertical left side wall and a vertical right side wall. Preferably, the bottom wall, the top wall, the left side wall and the right side wall form a cabinet front face. The method preferably comprises: (i) orienting the cabinet in a substantially horizontal position such that the cabinet front face is facing substantially vertically upward; (ii) placing the left door assembly on the cabinet front face, wherein the left door assembly comprises a substantially rectangular left door having a front face, a back face, an outer face, and an inner face; (iii) placing the right door assembly on the cabinet front face, wherein the right door assembly comprises a substantially rectangular right door having a front face, a back face, an outer face, and an inner face; (iv) placing a top and bottom T door fixture between the left and right door assemblies and clamping the left and right French doors and top and bottom T door fixtures together with a clamp, wherein the top and bottom T door fixtures ensure that the inner face of the left door assembly and the inner face of the right door assembly are parallel and the correct distance apart when the cabinet is substantially horizontal; (v) installing an adjustable top left hinge assembly; (vi) installing a top right hinge assembly; (vii) installing a bottom left hinge assembly; (viii) installing a bottom right hinge assembly; (ix) removing the clamp and top and bottom T door fixtures; and (x) orienting the cabinet in a substantially vertical position such that the cabinet front face is facing substantially horizontal, and adjusting the adjustable top left hinge to ensure that the inner face of the left door assembly and the inner face of the right door assembly are parallel and the correct distance apart when the cabinet is substantially vertical.

BRIEF DESCRIPTION OF THE FIGURES

These and other features, aspects and advantages of the invention will become more fully apparent from the following detailed description, appended claims, and accompanying drawings, wherein the drawings illustrate features in accordance with exemplary embodiments of the present invention, and wherein:

FIG. 9 is a right perspective exploded view of a left magnetic French door gasket assembly according to one embodiment of the present invention;

FIG. 9A is a front plan view of a left magnetic French door gasket assembly according to one embodiment of the present invention;

FIG. 9B is a left section view of a left magnetic French door gasket according to one embodiment of the present invention;

FIG. 10A is a front plan view of a right magnetic French door gasket assembly according to one embodiment of the present invention;

FIG. 10B is a left section view of a right magnetic French door gasket assembly according to one embodiment of the present invention;

FIG. 13AA is a left section view of a first elongate flexible magnet according to one embodiment of the present invention;

FIG. 13BB is a left section view of a second elongate flexible magnet according to one embodiment of the present invention;

FIG. 13CC is a left section view of a third elongate flexible magnet according to one embodiment of the present invention;

FIG. 17A is a rear plan view of a right bottom gasket plug according to one embodiment of the present invention;

FIG. 17B is a top view of a right bottom gasket plug according to one embodiment of the present invention;

FIG. 17C is a front plan view of a right bottom gasket plug according to one embodiment of the present invention;

FIG. 17D is a bottom plan view of a right bottom gasket plug according to one embodiment of the present invention;

FIG. 17E is a right perspective view of a right bottom gasket plug according to one embodiment of the present invention;

DETAILED DESCRIPTION OF THE INVENTION

Figure 1:
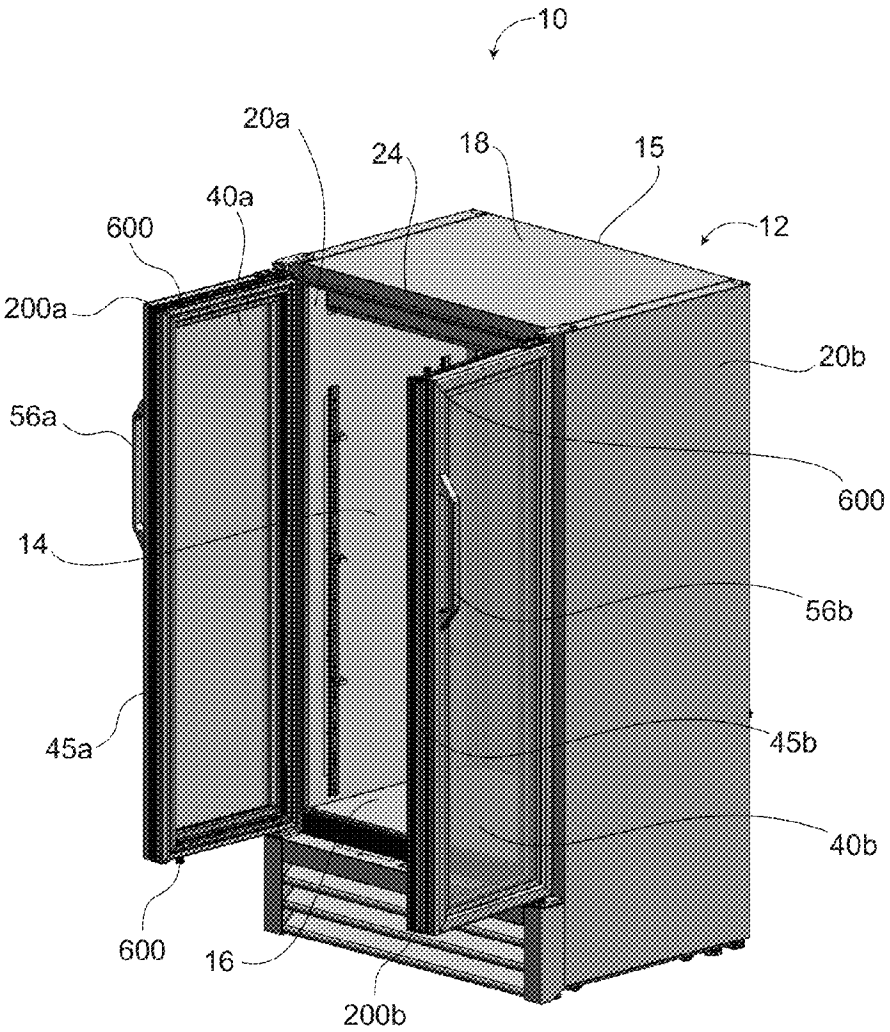
FIG. 1 is a right front perspective view of a refrigerator cooler having French doors wherein the French doors are open according to one embodiment of the present invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

It is to be understood, that certain embodiments of the refrigerator cooler are formed with left hand and right hand parts wherein the right hand parts are substantially similar to the left hand parts. Like portions of these parts are hereinafter designated by the same reference numerals, for example, the parts of right magnetic French door gasket assembly 200*b* on right door 41*b* being differentiated from the like parts of left magnetic French door gasket assembly 200*a* on left door 41*a* by replacing "a" with "b". Where there are differences between the left hand and right hand parts, those differences will be noted. Where no "a" or "b" is present following a reference numeral, such part may be identical in the left hand and right hand parts.

Figure 2:
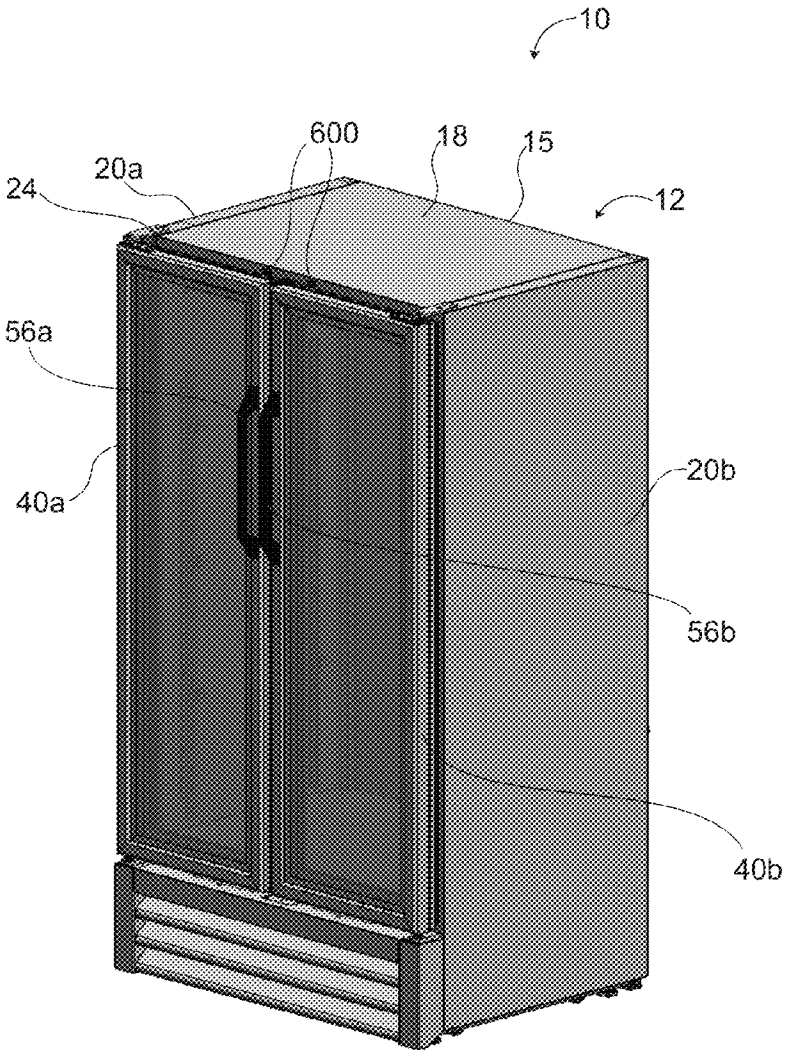
FIG. 2 is a right front perspective view of a refrigerator cooler having French doors wherein the French doors are closed according to one embodiment of the present invention.

FIGS. 1 and 2 illustrate certain principal components of one embodiment of refrigerator cooler 10. Refrigerator cooler 10 includes a cabinet 12 that has at least one storage compartment 14. Storage compartment 14 has an open front and is bounded by a vertical back wall 15, a horizontal bottom wall 16, a horizontal top wall 18, a vertical left side wall 20*a* and a vertical right side wall 20*b*. Horizontal bottom wall 16, horizontal top wall 18, vertical left side wall 20*a* and vertical right side wall 20*b* each form a part of front face 24 of cabinet 12 against which a gasket can seal. The walls of cabinet 12 may be thermally insulated with various insulating materials including, but not limited to, fiberglass insulation or open- or closed-cell foam comprised, for example, of polystyrene or polyurethane. Inside storage compartment 14 may be shelves, baskets, etc. (not shown) used to place, hold and/or store products for sale. Any type of commercially available shelf, basket and/or other product storage or display device may be placed inside storage compartment 14.

Figure 3:
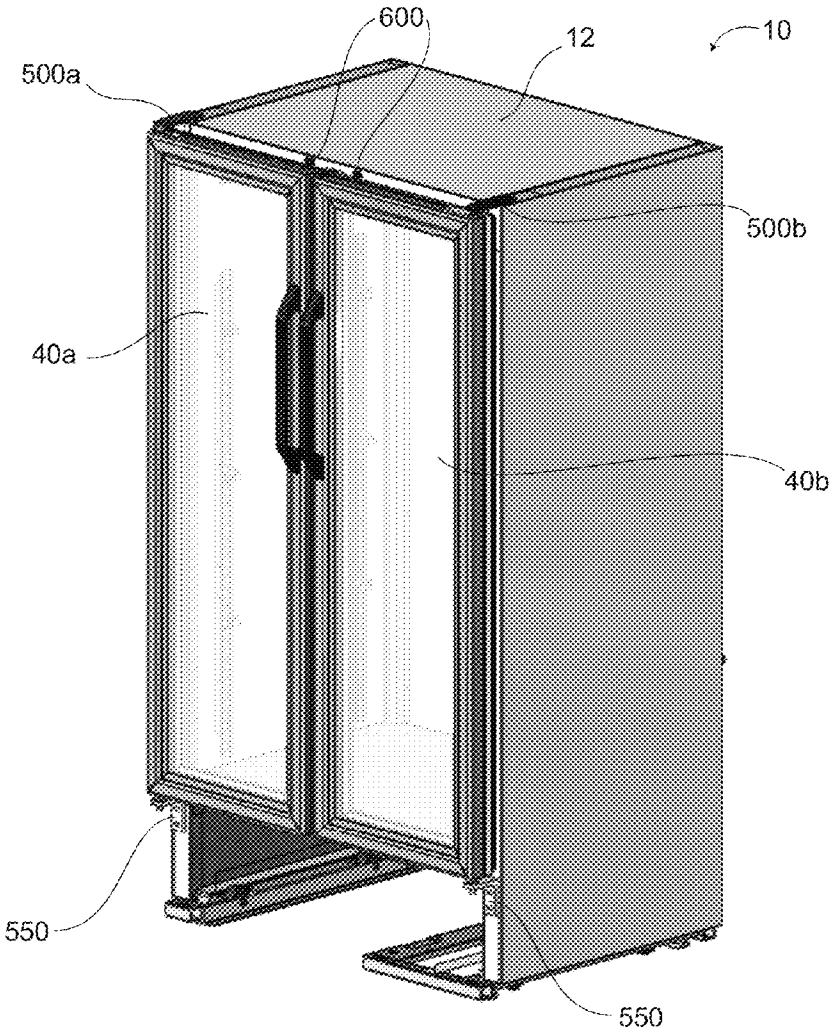
FIG. 3 is a right front perspective view of a refrigerator cooler having French doors wherein the French doors are closed according to one embodiment of the present invention.
Figure 4B:
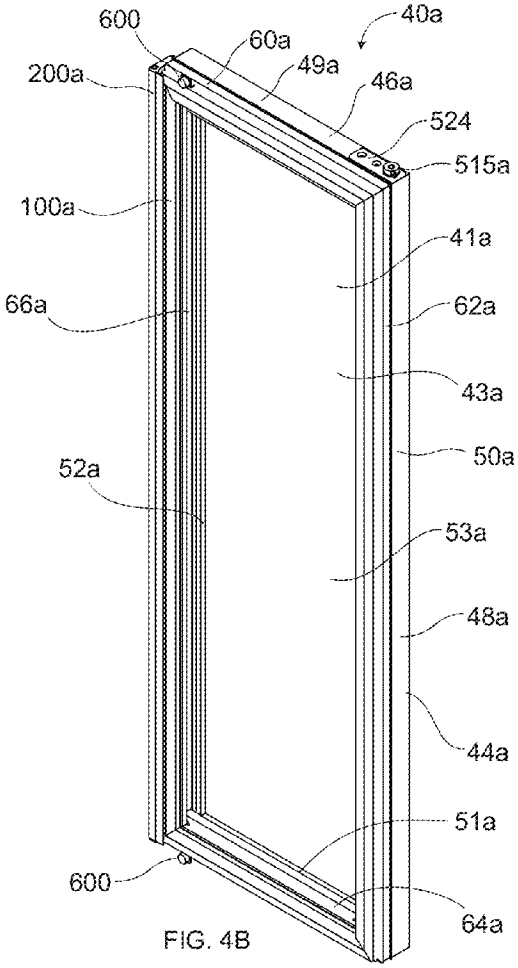
FIG. 4B is a left rear perspective view of the back of a left door assembly according to one embodiment of the present invention.
Figure 4A:
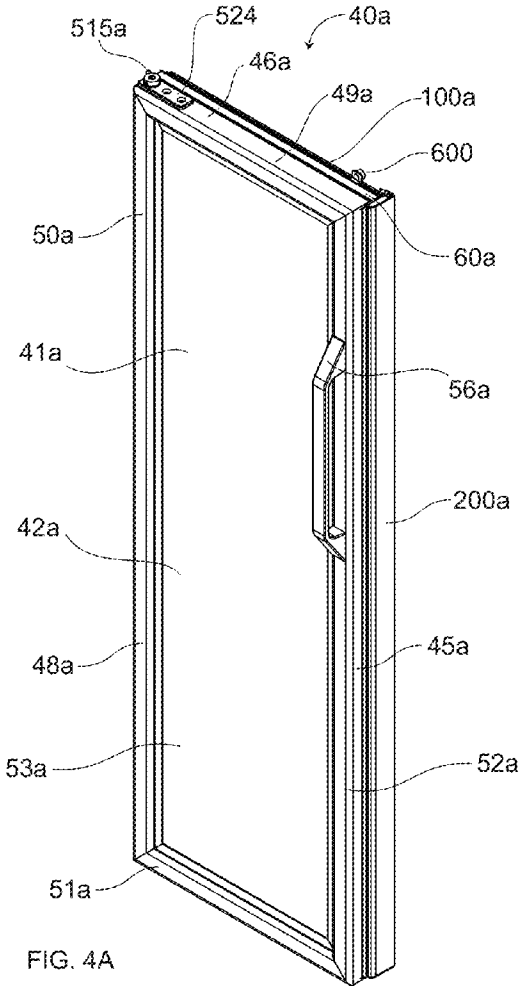
FIG. 4A is a right front perspective view of the front of a left door assembly according to one embodiment of the present invention.
Figure 5B:
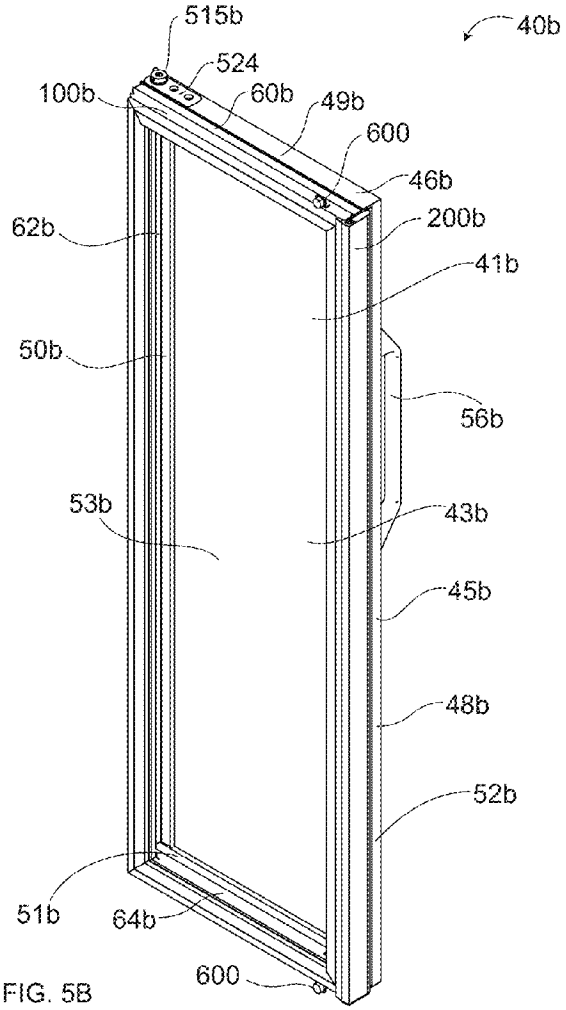
FIG. 5B is a left rear perspective view of the back of a right door assembly according to one embodiment of the present invention.
Figure 5A:
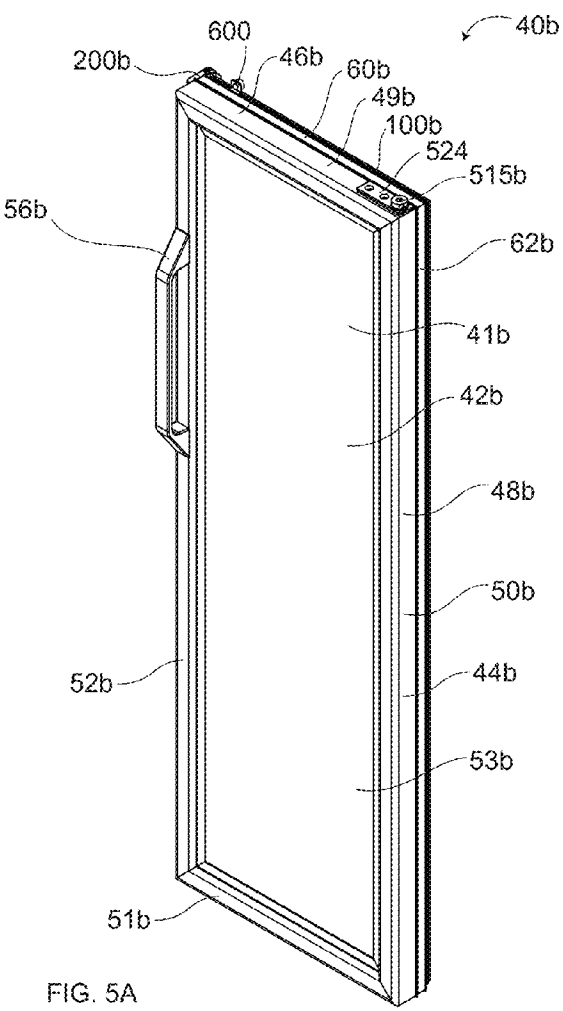
FIG. 5A is a right front perspective view of the front of a right door assembly according to one embodiment of the present invention.

Again as illustrated in FIG. 3, one embodiment of refrigerator cooler 10 further includes two door assemblies, a left door assembly 40*a* and a right door assembly 40*b*, which are rotatably affixed to cabinet 12 by hinge assemblies 500*a*, 500*b*, and 550. Referring now to FIGS. 4A and 4B, one embodiment of left door assembly 40*a* comprises substantially rectangular left door 41*a* having a left door front face 42*a*, a left door back face 43*a*, a left door outer face 44*a*, a left door inner face 45*a*, a left door top face 46*a* and a left door bottom face 47*a* (not shown). In this embodiment, left door 41*a* includes a left door frame 48*a* formed of top frame member 49*a*, outer frame member 50*a*, bottom frame member 51*a*, and inner frame member 52*a*. Insulated glass panel 53*a* is held in left door frame 48*a*. Referring now to FIGS. 5A and 5B, one embodiment of right door assembly 40*b* comprises substantially rectangular right door 41*b* having a right door front face 42*b*, a right door back face 43*b*, a right door outer face 44*b*, a right door inner face 45*b*, a right door top face 46*b* and a right door bottom face 47*b* (not shown). In this embodiment, right door 41*b* includes a right door frame 48*b* formed of top frame member 49*b*, outer frame member 50*b*, bottom frame member 51*b*, and inner frame member 52*b*. Insulated glass panel 53*b* is held in right door frame 48*b*. Preferably, door frame members 49*a*, 49*b*, 50*a*, 50*b*, 51*a*, 51*b*, 52*a*, 52*b* are constructed of an aluminum alloy; however in other embodiments, the door frame members 49*a*, 49*b*,

50*a*, 50*b*, 51*a*, 51*b*, 52*a*, 52*b* may be comprised of a variety of metals including, but not limited to, steel, stainless steel, titanium, and/or other pure metals or metal alloys. In another embodiment, the door frame members 49*a*, 49*b*, 50*a*, 50*b*, 51*a*, 51*b*, 52*a*, 52*b* may be comprised of a variety of other materials including, but not limited to, plastic, wood, fiberglass, carbon fiber, or other composites. In this embodiment, inner door frame members 52*a*, 52*b* have a channel for accepting the darts of magnetic French door gasket assemblies 200*a*, 200*b*, as described more fully elsewhere herein. Additionally, in one embodiment, the door frame members may be miter cut and secured to one another to form left and right door frames 48*a*, 48*b*, via a variety of means including, but not limited to, screws, rivets, adhesives, welds, brazing, etc. In other embodiments, left and right door frames 48*a*, 48*b* may be constructed in any way known in the art for constructing refrigerator doors or doors generally. In certain embodiments, the width of door frame members 49*a*, 49*b*, 50*a*, 50*b*, 51*a*, 51*b*, 52*a*, 52*b* may be minimized and the size of insulated glass panels 53*a*, 53*b* may be increased so that more products stored in refrigerator cooler 10 can be viewed by consumers.

As shown in FIGS. 4A, 4B, 5A and 5B, in this particular embodiment, left door assembly 40*a* and right door assembly 40*b* further include gasket retainers 60*a*, 60*b*, 62*a*, 62*b*, 64*a*, 64*b*, 66*a*, 66*b* affixed to the back faces 43*a*, 43*b* of left and right doors 41*a*, 41*b*, respectively. Accordingly, affixed to back face 43*a* of left door 41*a* is left door top gasket retainer 60*a*, left door outer gasket retainer 62*a*, left door bottom gasket retainer 64*a*, and left door inner gasket retainer 66*a*. Similarly, affixed to back face 43*b* of right door 41*b* is right door top gasket retainer 60*b*, right door outer gasket retainer 62*b*, right door bottom gasket retainer 64*b*, and right door inner gasket retainer 66*b* (not shown). Gasket retainers 60*a*, 60*b*, 62*a*, 62*b*, 64*a*, 64*b*, 66*a*, 66*b* may have channels for accepting the darts of a perimeter gasket and inner gasket retainers 66*a*, 66*b* have an additional channel for accepting the darts of magnetic French door gasket assemblies 200*a*, 200*b*, as described more fully elsewhere herein. Preferably, gasket retainers 60*a*, 60*b*, 62*a*, 62*b*, 64*a*, 64*b*, 66*a*, 66*b* are comprised of extruded polyvinyl chloride (PVC) that is black in color; however in other embodiments a variety of other materials may be used including, but not limited to, metal, plastic, wood, fiberglass, carbon fiber, or other composites. It is to be understood that colors other than black may also be used without departing from the scope of the present disclosure. Gasket retainers 60*a*, 60*b*, 62*a*, 62*b*, 64*a*, 64*b*, 66*a*, 66*b* may be affixed to the back faces 43*a*, 43*b* of left and right doors 41*a*, 41*b* by a variety of means including, but not limited to, screws, rivets, adhesives, welds, brazing, etc. In other embodiments, perimeter gasket and French door gaskets may be secured in any way known in the art directly to left and right doors 41*a*, 41*b* without the use of any gasket retainers.

While FIGS. 4A, 4B, 5A and 5B illustrate left and right door assemblies 40*a*, 40*b* with left and right door frames 48*a*, 48*b* and insulated glass panels 53*a*, 53*b*, it is to be understood that in certain embodiments of left and right door assemblies 40*a*, 40*b* other door constructions may be used. For example, in one embodiment, left and right door assemblies 40*a*, 40*b* may each include a door panel, wherein the door panel may be solid or hollow and/or filled with insulation. Additionally, as shown in FIGS. 1, 2, 3, 4A, 4B, 5A, 5B, handles 56*a*, 56*b* are affixed to front faces 42*a*, 42*b* of the left and right doors 41*a*, 41*b* proximate inner faces 45*a*, 45*b*. It is to be understood that any type of handle or other door opening means known in the art may be used to open left and right doors 41*a*, 41*b* including, but not limited to, knobs, straps, levers, etc.

Figure 6:
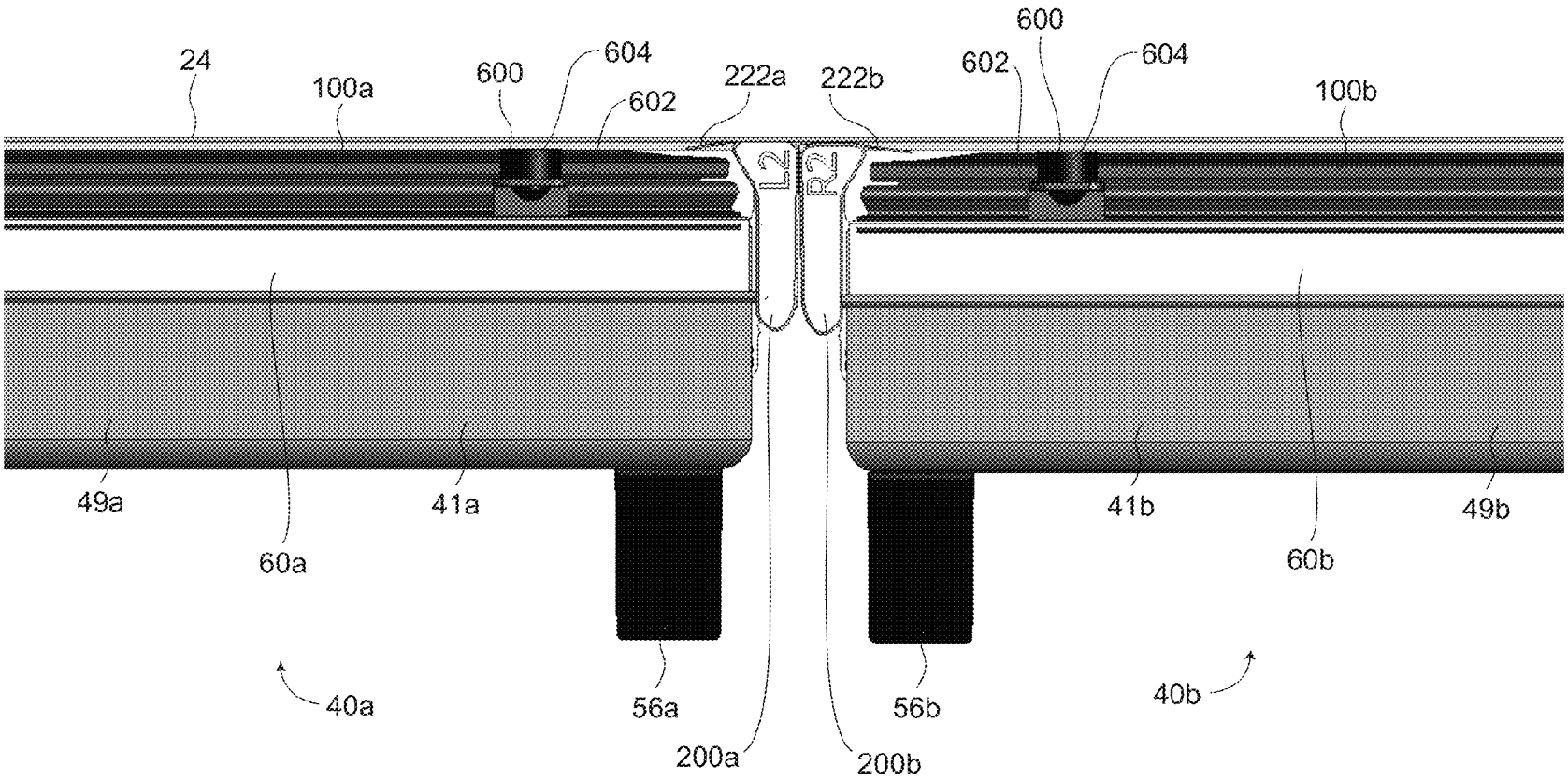
FIG. 6 is a top view of a part of a refrigerator cooler wherein the French doors are closed according to one embodiment of the present invention.
Figure 7:
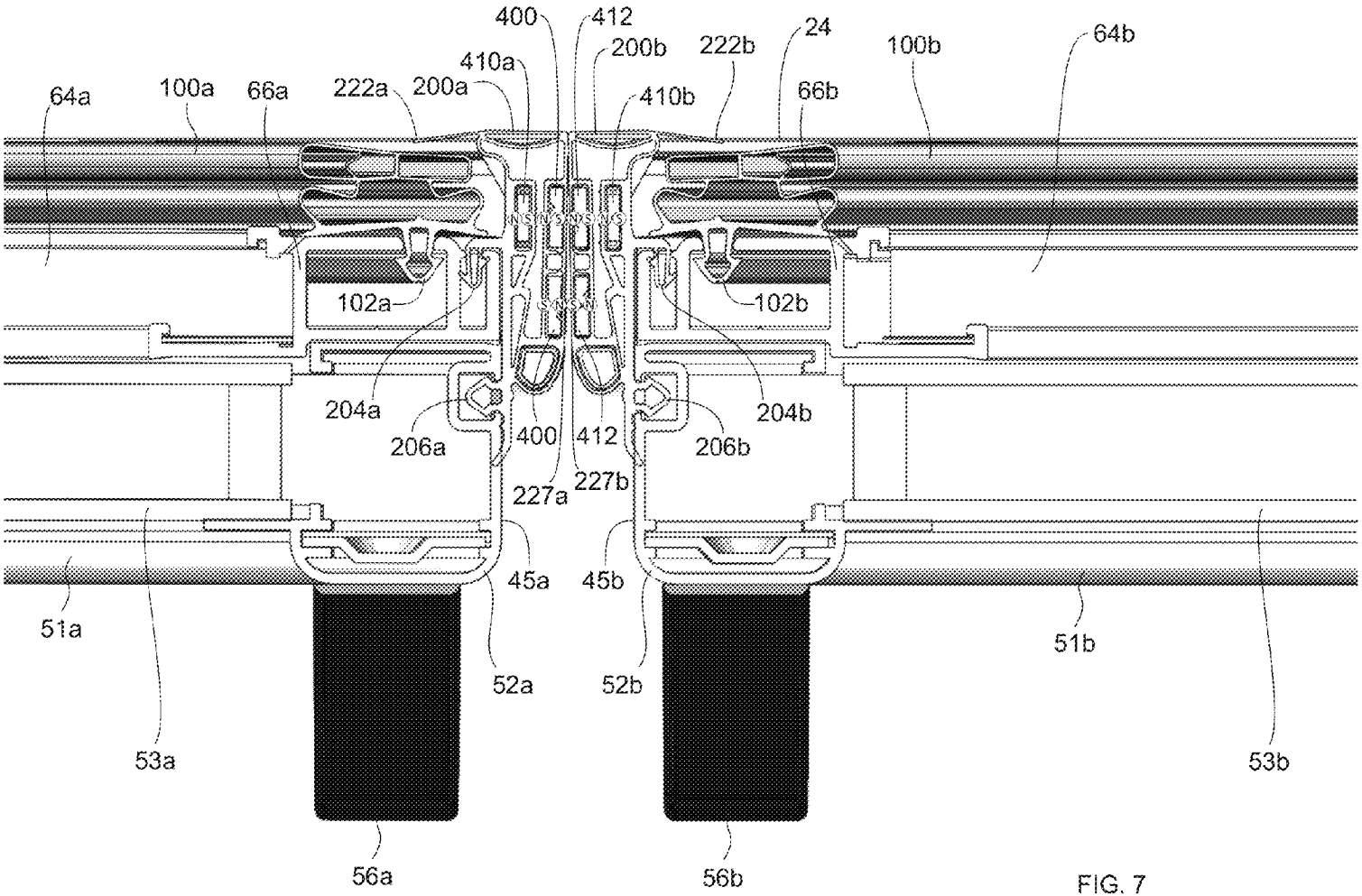
FIG. 7 is a top section view of a part of a refrigerator cooler wherein the French doors are closed according to one embodiment of the present invention.
Figure 8C:
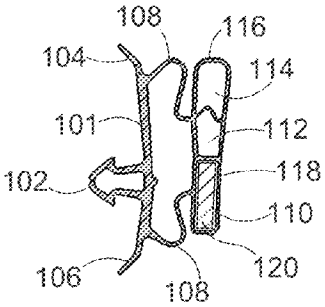
FIG. 8C is a detail right section view of a perimeter gasket according to one embodiment of the present invention.
Figure 8B:
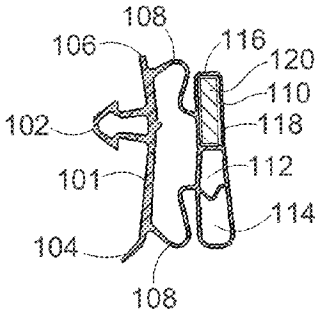
FIG. 8B is a detail right section view of a perimeter gasket according to one embodiment of the present invention.
Figure 8A:
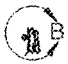
FIG. 8A is a detail right section view of a perimeter gasket according to one embodiment of the present invention.
Figure 8A:
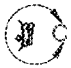
Figure 8:
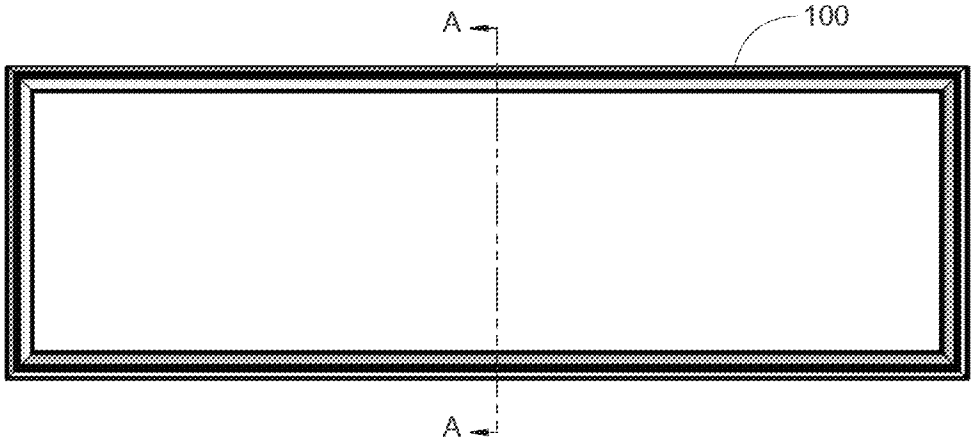
FIG. 8 is a back plan view of a perimeter gasket according to one embodiment of the present invention.

FIGS. 4B and 5B illustrate one embodiment of perimeter gaskets 100*a*, 100*b*. Perimeter gaskets 100*a*, 100*b* are affixed to the back faces 43*a*, 43*b* of left and right doors 41*a*, 41*b*. Perimeter gaskets 100*a*, 100*b* contact and seal against cabinet front face 24 when left and right door assemblies 40*a*, 40*b* are closed as illustrated in FIGS. 6 and 7. Referring now to FIG. 8, one embodiment of perimeter gasket 100 is shown in detail. In this particular embodiment, perimeter gasket 100 is constructed of extruded pieces of flexible gasket material that have been miter cut and sealed together at the corners. Preferably, the flexible gasket material used for perimeter gasket 100 is extruded polyvinyl chloride (PVC) that is flexible and black in color; however in other embodiments a variety of other materials may be used including, but not limited to, natural or synthetic rubber, or other suitable elastomer known in the art. It is to be understood that colors other than black may also be used without departing from the scope of the present disclosure. In one particular embodiment, the flexible gasket material may be sealed together using silicone adhesive; however in other embodiments other adhesives may be used including, but not limited to, epoxy, rubber cement, cyanoacrylate, hot glue or any other adhesive known in the art. In yet other embodiments, for example, the flexible gasket material may be sealed together through the use of plastic welding techniques known in the art including, but not limited to, hot gas welding, heat sealing, extrusion welding, hot plate welding, ultrasonic welding, solvent welding, laser welding, etc. As shown in detail in FIGS. 8B and 8C, one embodiment of perimeter gasket 100 includes various elements, all of which may be extruded as a single piece of gasket material. Perimeter gasket 100 may have base portion 101, dart 102 which extends from a first side of base portion 101 and is substantially orthogonal to base portion 101, inner tab 104, outer tab 106, webs 108 which extend from a second side of base portion 101, and sealing surface portion 116 attached to webs 108. Sealing surface portion 116 includes three chambers 110, 112, 114 and sealing surface 118. While this particular embodiment of sealing surface portion 116 of perimeter gasket 100 includes three chambers, in other embodiments, fewer or greater numbers of chambers may be used (e.g., 1 chamber, 2 chambers, 4 chambers, 5 chambers, etc.). In one embodiment, elongate flexible magnet 120 may be inserted into chamber 110. Elongate flexible magnet 120 is attracted to front face 24 of cabinet 12 thereby assisting in sealing perimeter gasket 100 to a portion of cabinet front face 24. The orientation of the polarity of elongate flexible magnet 120 is not critical as it will be attracted to the metal of cabinet front face 24 whether the (S) pole is proximate cabinet front face 24 or the (N) pole is proximate cabinet front face 24. In some embodiments, chambers 110, 112, 114 may be hollow or empty, while in other embodiments, for example, elongate flexible magnets may be inserted into any combination of chambers 110, 112, and/or 114. The elongate flexible magnets may comprise magnetic material which may be any type of commercially available magnetic material known in the art. Dart 102 may be inserted into channels in door frame members 49*a*, 49*b*, 50*a*, 50*b*, 51*a*, 51*b*, 52*a*, 52*b* in order to removably affix perimeter gasket 100*a* to left door 41*a* and perimeter gasket 100*b* to right door 41*b*. In certain embodiments, perimeter gasket 100 may not include a dart, but may instead be secured to left and right doors 41*a*, 41*b* via a variety of means including, but not limited to, screws, rivets, adhesives, etc. As shown in FIG. 8B, outer tab 106 may be trimmed back on the side of perimeter gasket 100*a* that is proximate left door inner face 45*a* in order to ensure that magnetic French door gasket assembly 200*a* can overlap perimeter gasket 100*a* and seal properly. In this particular embodiment, outer tab 106 that is on the side of perimeter gasket that is proximate left door inner face 45*a* is trimmed back by about ⅛ in.; however in other embodiments, outer tab 106 may be trimmed back by any amount to ensure that magnetic French door gasket assembly 200*a* can overlap perimeter gasket 54*a* and seal properly, which may be, for example, more or less than about ⅛ in. (e.g., about 1/16 in., about ¼ in., about ⅜ in., etc.). Sealing surface 118 contacts and releasably seals against cabinet front face 24 when left and right door assemblies 40*a*, 40*b* are closed. Outer tab 106 may be trimmed back on the side of perimeter gasket 100*b* that is proximate right door inner face 45*b* in a similar manner.

Figure 10:
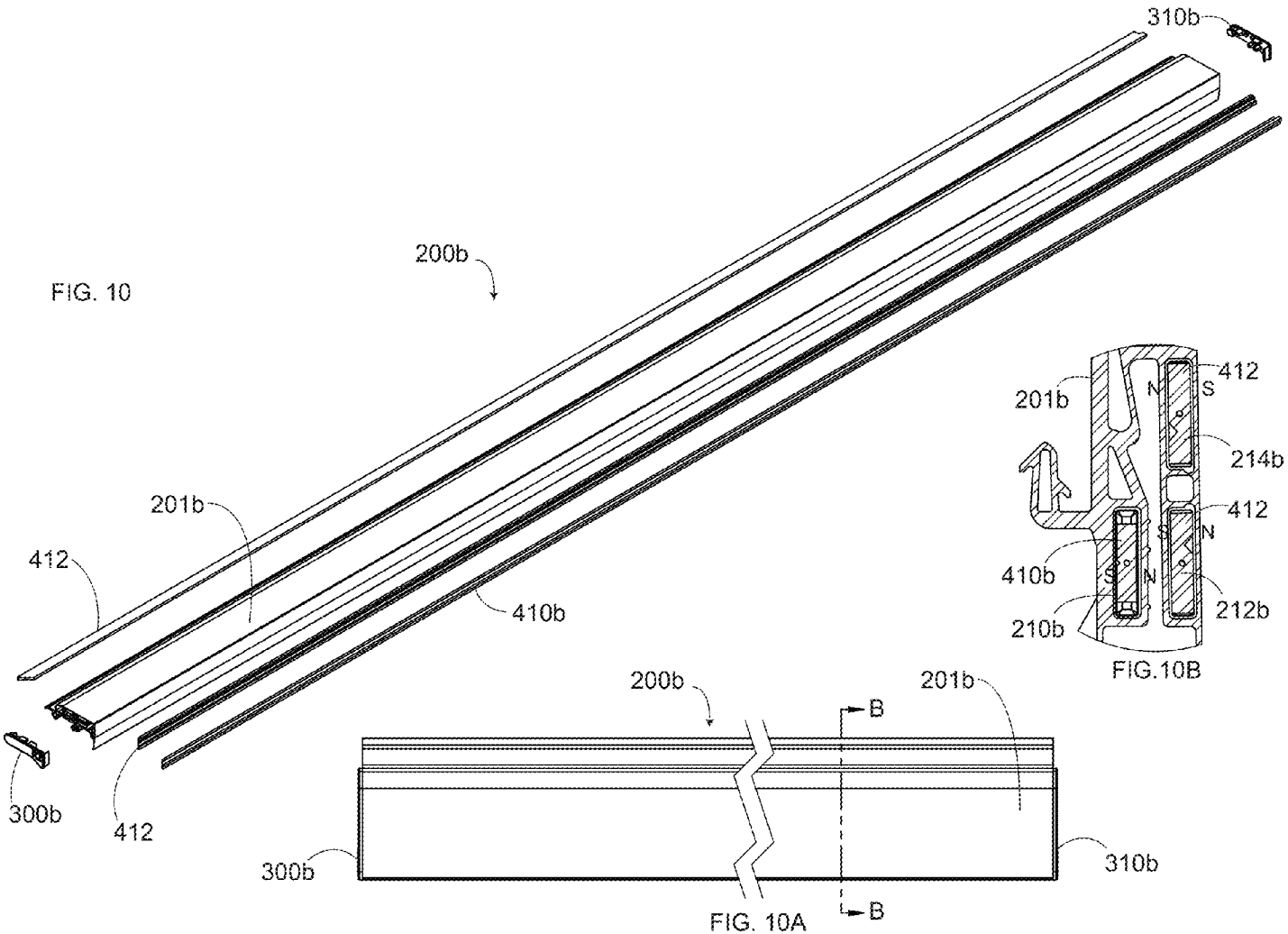
FIG. 10 is a right perspective exploded view of a right magnetic French door gasket assembly according to one embodiment of the present invention.

Returning again to FIGS. 1, 6 and 7, one embodiment of magnetic French door gasket assemblies 200*a*, 200*b* as affixed to refrigerator cooler 10, are illustrated. In one particular embodiment, magnetic French door gasket assemblies 200*a*, 200*b* are separate gaskets from perimeter gaskets 100*a*, 100*b*. By utilizing separate magnetic French door gasket assemblies 200*a*, 200*b* and perimeter gaskets 100*a*, 100*b*, the French door gasket assemblies 200*a*, 200*b* can be replaced after they have become worn through repeated opening and closing of the left and right door assemblies 40*a*, 40*b* in commercial environments. It certain cases, magnetic French door gasket assemblies 200*a*, 200*b* may wear faster than perimeter gaskets 100*a*, 100*b*; thus permitting replacement of magnetic French door gasket assemblies 200*a*, 200*b* and perimeter gaskets 100*a*, 100*b* individually, as needed, which aids in reducing maintenance costs. In one embodiment, magnetic French door gasket assemblies 200*a*, 200*b* are affixed to inner faces 45*a*, 45*b* of left and right doors 41*a*, 41*b*. As shown in FIGS. 6 and 7, magnetic French door gasket assemblies 200*a*, 200*b* may contact and seal against one another when left and right door assemblies 40*a*, 40*b* are closed. Referring now to FIGS. 9, 9A, 9B, 10, 10A and 10B, one embodiment of magnetic French door gasket assemblies 200*a*, 200*b* are shown in detail in exploded view. It is to be understood, that right magnetic French door gasket assembly 200*b* is substantially similar to left magnetic French door gasket assembly 200*a*. Like portions of these gasket assemblies are hereinafter designated by the same reference numerals, the parts of right magnetic French door gasket assembly 200*b* on right door 41*b* being differentiated from the like parts of left magnetic French door gasket assembly 200*a* on left door 41*a* by replacing "a" with "b". Where there are differences between the left and right magnetic French door gasket assemblies 200*a*, 200*b*, those differences will be noted. In this particular embodiment, shown in FIGS. 9, 9A and 9B, left magnetic French door gasket assembly 200*a* includes left extruded flexible French door gasket 201*a*, left top gasket plug 300*a*, left bottom gasket plug 310*a*, and first and second magnets 400 and magnet 410*a*. As shown in FIGS. 10, 10A and 10B, one embodiment of right magnetic French door gasket assembly 200*b* includes right extruded flexible French door gasket 201*b*, right top gasket plug 300*b*, right bottom gasket plug 310*b*, and first and second magnets 412 and magnet 410*b*.

Figure 11:
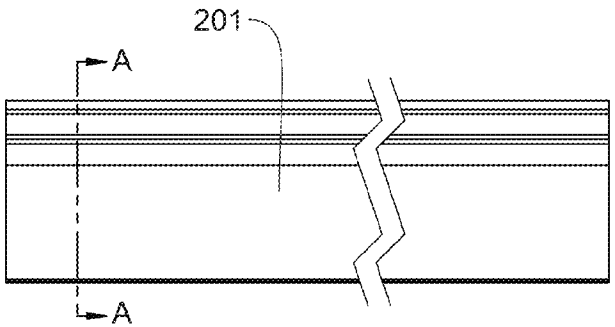
FIG. 11 is a front plan view of a magnetic French door gasket according to one embodiment of the present invention.
Figure 11A:
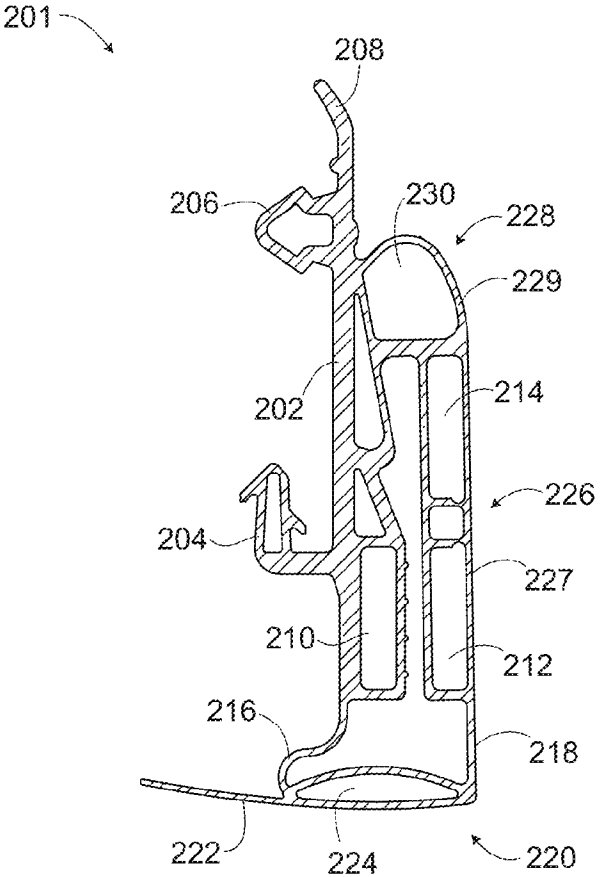
FIG. 11A is a left section view of a magnetic French door gasket according to one embodiment of the present invention.

Preferably, the flexible gasket material used for French door gasket 201*a* is extruded polyvinyl chloride (PVC) that is flexible and black in color; however in other embodiments a variety of other materials may be used including, but not limited to, natural or synthetic rubber, or other suitable elastomer known in the art. It is to be understood that colors other than black may also be used without departing from the scope of the present disclosure. In FIGS. 11 and 11A one embodiment of French door gasket 201 is shown comprising various elements, all of which are extruded as a single piece of gasket material. French door gasket 201 may have base portion 202, anterior sealing portion 220, posterior sealing portion 228 and gasket-to-gasket sealing portion 226. A first dart 204 is disposed substantially parallel to base portion 202 and is connected to the first side of base portion 202 near a middle region of base portion 202 between anterior sealing portion 220 and posterior sealing portion 228. First dart 204 is insertable into a channel in left and right door inner gasket retainers 66*a*, 66*b*. Extending substantially orthogonal from a first side of base portion 202, proximate posterior sealing portion 228, is second dart 206. Second dart 206 is insertable into a channel in left and right door inner frame members 52*a*, 52*b*. In certain embodiments, second dart 206 may then be sealed at top and bottom of magnetic French door gasket assemblies 200*a*, 200*b* using silicone caulk or some other suitable commercially available sealant in order to prevent food products, water, dirt, dust, and/or other foreign objects from entering second dart 206. Because first dart 204 and second dart 206 are disposed substantially orthogonal to one another, the ease with which French door gasket assemblies 200*a*, 200*b* could be pulled away from left and right doors 41*a*, 41*b* is reduced. Additionally, the orientation and location of first dart 204 and second dart 206 permit easy installation by hand. By positioning first dart 204 substantially parallel to base portion 202, French door gasket assemblies 200*a*, 200*b* can be pushed into the channel in left and right door inner gasket retainers 66*a*, 66*b* (see FIG. 7) with a finger placed directly behind first darts 204. By locating second dart 206 proximal to posterior sealing portion 228, French door gasket assemblies 200*a*, 200*b* can be pushed into the channel in left and right door inner frame members 52*a*, 52*b* (see FIG. 7) with a finger placed directly on the second side of base portions 202 behind webs 229. Accordingly, no portion of flexible gasket 201 hinders the ability to put sufficient force directly behind and in line with first and second darts 204, 206.

Extending from base portion 202 and away from posterior sealing portion 228 is tab 208. Web 229 extends from base portion 202 to gasket-to-gasket sealing portion 226 defining posterior tab receiving chamber 230, wherein posterior tab receiving chamber 230 is adapted to receive a tab of left top gasket plug 300*a*, left bottom gasket plug 310*a*, right top gasket plug 300*b*, right bottom gasket plug 310*b*, as described more fully elsewhere herein. Web 216 connects base portion 202 with anterior sealing portion 220 and web 218 connects anterior sealing portion 220 with gasket-to-gasket sealing portion 226. At anterior sealing portion 220 is anterior tab receiving chamber 224 which is adapted to receive a tab of left top gasket plug 300*a*, left bottom plug 310*a*, right top gasket plug 300*b*, right bottom plug 310*b*, as described more fully elsewhere herein. Extending from anterior sealing portion 220 is sealing flange 222 which partially covers perimeter gasket sealing surface 118 and is disposed between gasket sealing surface 118 and cabinet front face 24 when left and right door assemblies 40*a*, 40*b* are closed. Sealing flange 222 is of sufficient width to partially cover perimeter gasket sealing surface 118 without getting bent back and stuck between perimeter gasket 100 and the magnetic French door gasket assembly 200. Additionally, sealing flange 222 is not so wide as to interfere with the sealing of the gaskets. Preferably, sealing flange 222 may be about ⅜ in. wide; however, in certain embodiments, sealing flange 222 may be from about ¼ in. wide to about ⅝ in. wide (e.g., about ¼ in., about ⅜ in., about ½ in., about ⅝ in.).

With respect to left magnetic French door gasket assembly 200*a*, adjacent to base portion 202 and between base portion 202 and gasket-to-gasket sealing portion 226 is chamber 210 which is adapted to receive flexible magnet 410, as described more fully elsewhere herein. Gasket-to-gasket sealing portion 226 includes chambers 212, 214 and gasket-to-gasket sealing surface 227, wherein chamber 212 is adapted to receive a first magnet 400 and chamber 214 is adapted to receive a second magnet 400, as described more fully elsewhere herein. In this particular embodiment as shown in FIG. 9B, first and second magnets 400 are identical, however the orientation of first magnet 400 is different than the orientation of second magnet 400 in left magnetic French door gasket assembly 200*a*. Now with respect to right magnetic French door gasket assembly 200*b*, adjacent to base portion 202 and between base portion 202 and gasket-to-gasket sealing portion 226 is chamber 210 which is adapted to receive flexible magnet 410, as described more fully elsewhere herein. Gasket-to-gasket sealing portion 226 includes chambers 212, 214 and gasket-to-gasket sealing surface 227, wherein chamber 212 is adapted to receive a first magnet 412 and chamber 214 is adapted to receive a second magnet 412, as described more fully elsewhere herein. In this particular embodiment as shown in FIG. 10B, first and second magnets 412 are identical, however the orientation of first magnet 412 is different than the orientation of second magnet 412 in right magnetic French door gasket assembly 200*b*. In other embodiments, first and second magnets may be different in size, shape, polarity, strength of magnetic force, material composition, etc. Flexible magnets 400, 410, 412 comprise magnetic material which may be any type of commercially available magnetic material known in the art.

Figure 12:
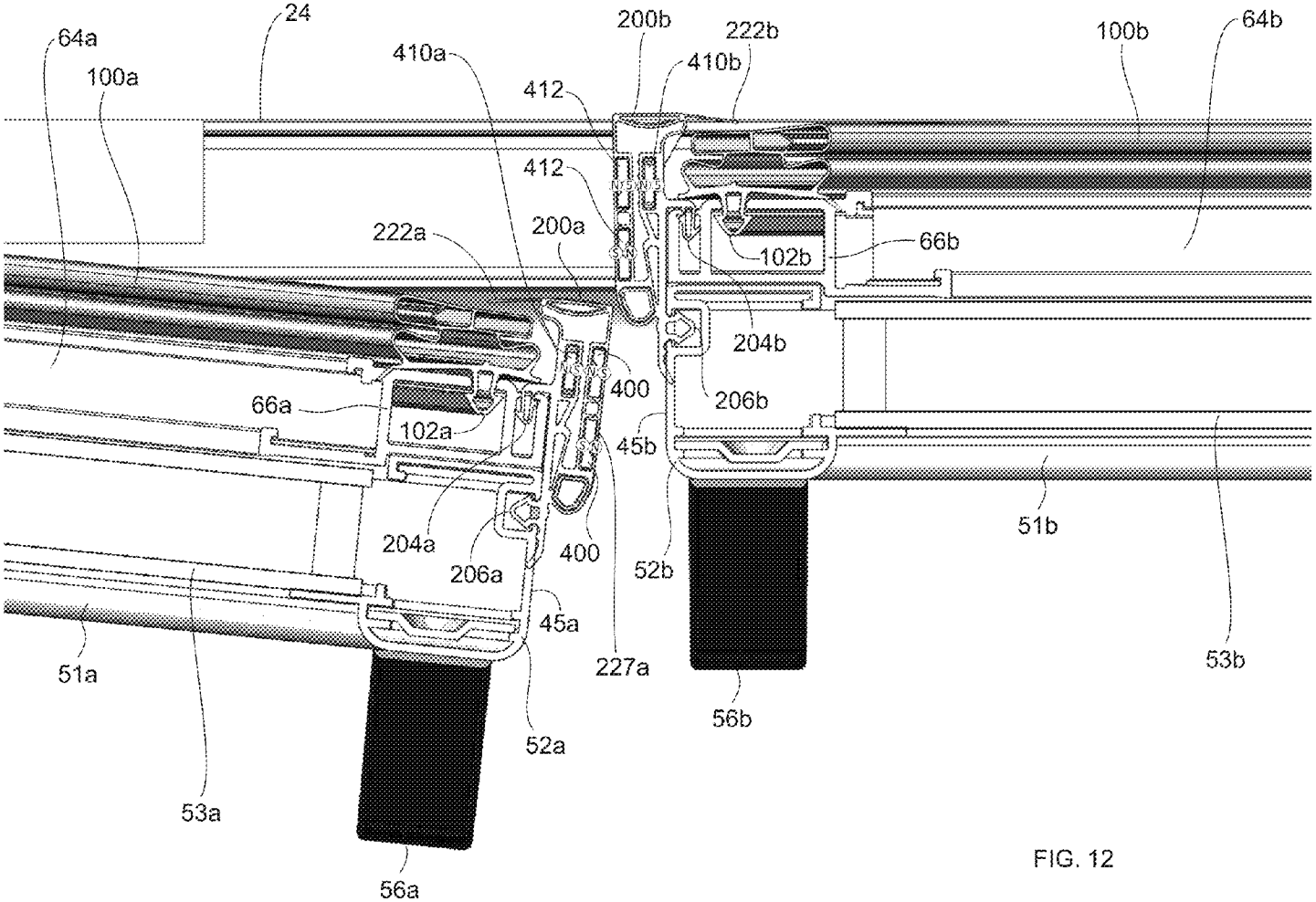
FIG. 12 is a top section view of a part of a refrigerator cooler wherein a left door is partially open according to one embodiment of the present invention.

As illustrated in FIGS. 9B and 10B, left and right magnetic French door gasket assemblies 200*a*, 200*b* may be constructed and oriented so that magnetic polarities of magnets 400 and 412 are opposite so that magnets 400 and 412 are attracted to one another when left and right door assemblies 40*a*, 40*b* are closed. Therefore as illustrated in FIG. 7, the south pole (S) of first magnet 400 is attracted to north pole (N) of first magnet 412 and north pole (N) of second magnet 400 is attracted to south pole (S) of second magnet 412. The attraction of these magnets 400, 412 cause left and right gasket-to-gasket sealing surfaces 227*a*, 227*b* to come into contact thereby sealing refrigerator cooler 10. When either left door assembly 40*a* or right door assembly 40*b* are opened, the similar polarities of magnets 400 and 412 are proximate and pass one another causing magnets 400 and 412 to repel one another, moving left and right gasket-to-gasket sealing surfaces 227*a*, 227*b* apart and thereby reducing wiping or scrubbing contact between left and right gasket-to-gasket sealing surfaces 227*a*, 227*b*. For example, as illustrated in FIG. 12, when left door assembly 40*a* is opened, the south pole (S) of first magnet 400 is brought near and past the south pole (S) of second magnet 412 and the similar polarities cause first magnet 400 and second magnet 412 to repel. The repelling forces of first magnet 400 and second magnet 412 are assisted by magnets 410*a*, 410*b*. When left and right door assemblies 40*a*, 40*b* are closed, the magnetic attractive forces between first magnet 400 and first magnet 412 are sufficient to overcome the magnetic attractive forces between magnet 410*a* and first magnet 400 and magnet 410*b* and first magnet 412. However, when either left door assembly 40*a* or right door assembly 40*b* are opened, the north pole (N) of first magnet 400 is attracted to the south pole (S) of magnet 410*a* and the south pole (S) of first magnet 412 is attracted to the north pole (N) of magnet 410*b*. These attractive forces aid in reducing wiping or scrubbing contact between left and right gasket-to-gasket sealing surfaces 227*a*, 227*b*. For example, when left door assembly 40*a* is opened, the north pole (N) of first magnet 400 is brought near the south pole (S) of magnet 410*a* and the similar polarities assist in the repelling forces between first magnet 400 and second magnet 412.

Figure 13A:
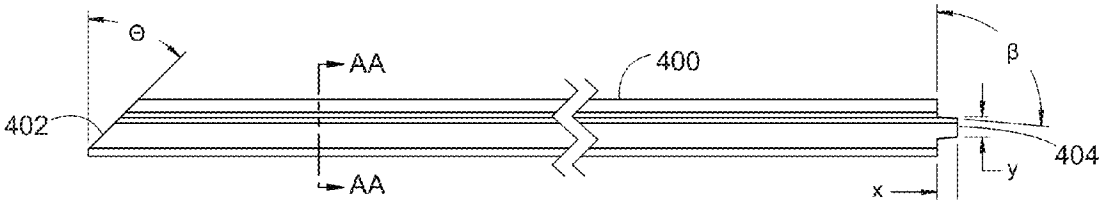
FIG. 13A is a front plan view of a first elongate flexible magnet according to one embodiment of the present invention.
Figure 13B:
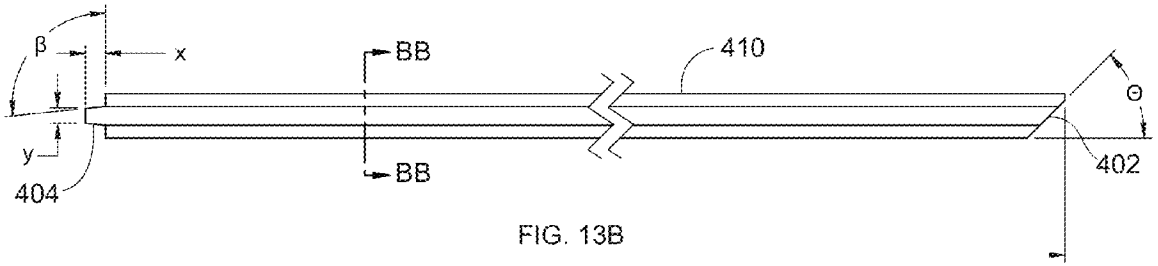
FIG. 13B is a front plan view of a second elongate flexible magnet according to one embodiment of the present invention.
Figure 13C:
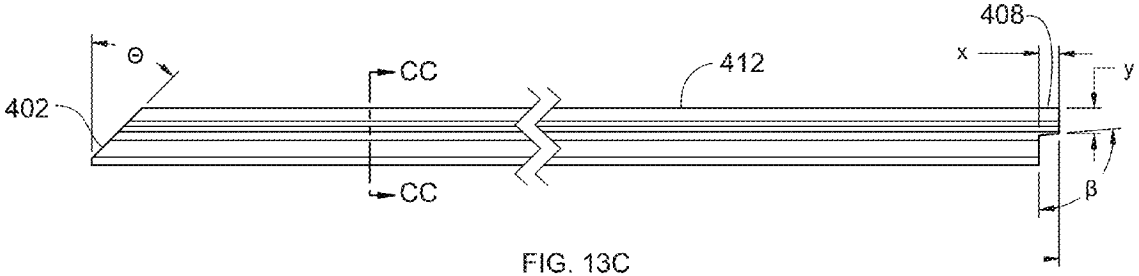
FIG. 13C is a front plan view of a third elongate flexible magnet according to one embodiment of the present invention.
Figure 13A:
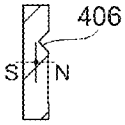
Figure 13B:
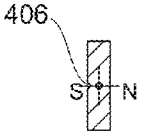
Figure 13C:
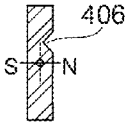
Figure 14D:
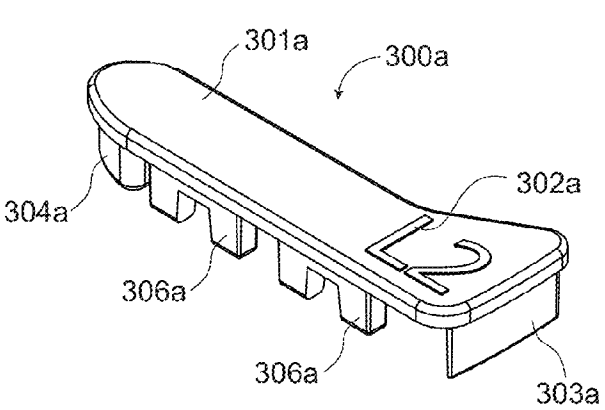
FIG. 14D is a right perspective view of a left top gasket plug according to one embodiment of the present invention.
Figure 14A:
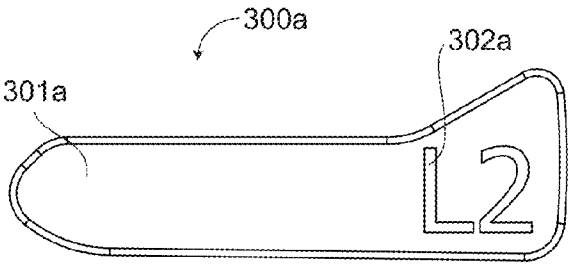
FIG. 14A is a top view of a left top gasket plug according to one embodiment of the present invention.
Figure 14B:
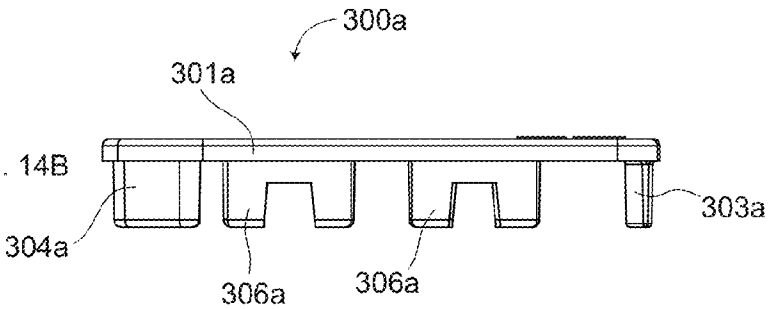
FIG. 14B is a front plan view of a left top gasket plug according to one embodiment of the present invention.
Figure 14C:
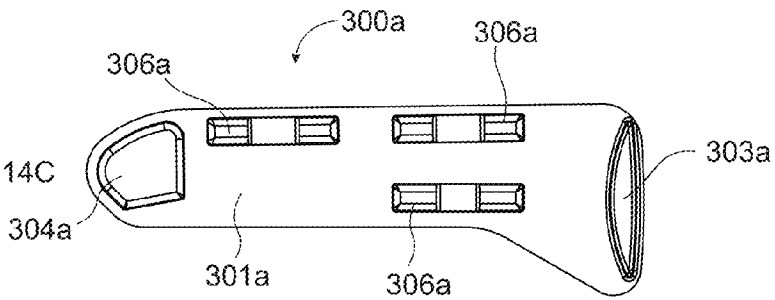
FIG. 14C is a bottom plan view of a left top gasket plug according to one embodiment of the present invention.
Figure 15D:
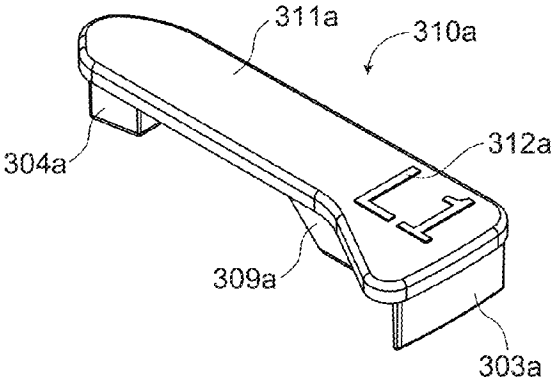
FIG. 15D is a right perspective view of a left bottom gasket plug according to one embodiment of the present invention.
Figure 15A:
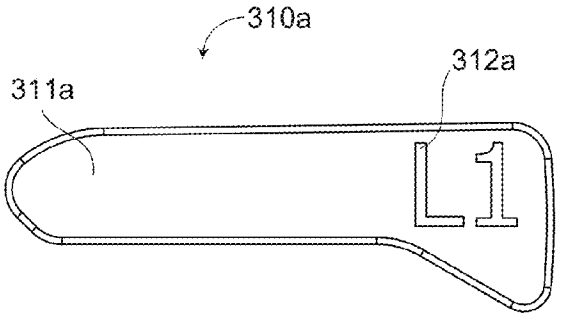
FIG. 15A is a top view of a left bottom gasket plug according to one embodiment of the present invention.
Figure 15B:
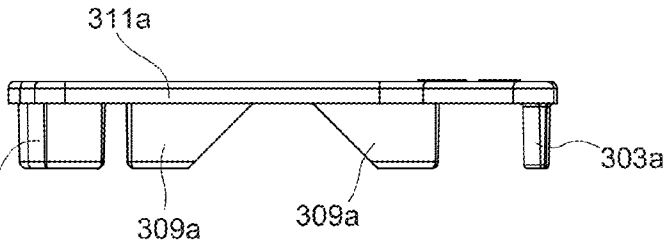
FIG. 15B is a front plan view of a left bottom gasket plug according to one embodiment of the present invention.
Figure 15C:
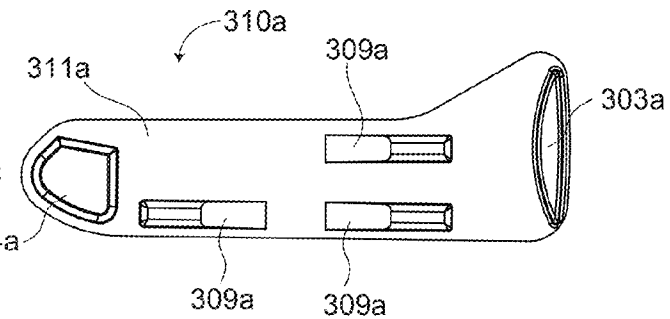
FIG. 15C is a bottom plan view of a left bottom gasket plug according to one embodiment of the present invention.
Figure 16D:
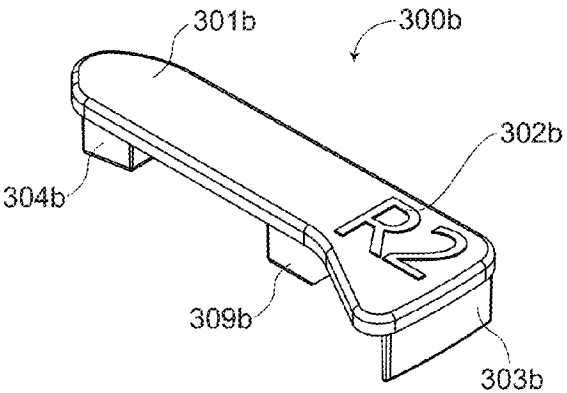
FIG. 16D is a right perspective view of a right top gasket plug according to one embodiment of the present invention.
Figure 16A:
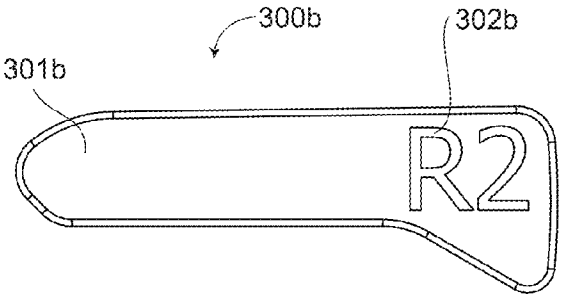
FIG. 16A is a top view of a right top gasket plug according to one embodiment of the present invention.
Figure 16B:
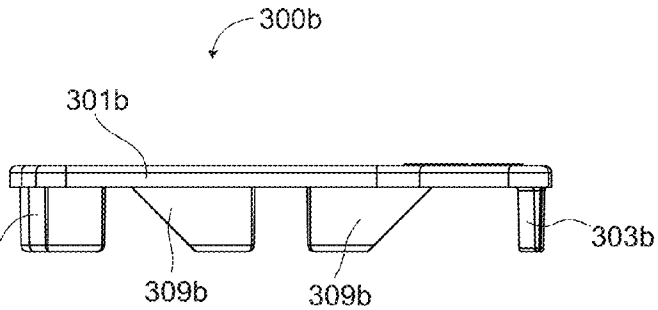
FIG. 16B is a front plan view of a right top gasket plug according to one embodiment of the present invention.
Figure 16C:
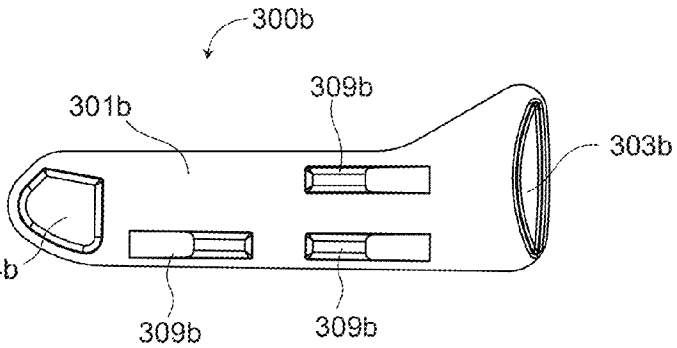
FIG. 16C is a bottom plan view of a right top gasket plug according to one embodiment of the present invention.

As illustrated in FIGS. 13A, 13B and 13C, one embodiment of magnets 400, 410 and 412 include elements to assist in ensuring that the polarities of the magnets are correct during manufacture and use. As shown in FIGS. 13A and 13AA, one embodiment of magnet 400 is an elongate thin flexible magnet with a substantially rectangular cross section. A first end of magnet 400 has a miter cut 402 at angle θ. In this particular embodiment angle θ of miter cut 402 is about 45 degrees; however in other embodiments, for example, angle θ of miter cut may be between about 10 and about 80 degrees (e.g., about 10 degrees, about 20 degrees, about 30 degrees, about 40 degrees, about 50 degrees, about 60 degrees, about 70 degrees, about 80 degrees). A second end of magnet 400 has a center tab 404. In this particular embodiment, center tab 404 has a length x and a width y, wherein x is preferably about ⅛ in. and wherein y is preferably about ⅛ in. The sides of center tab 404 are at an angle β, wherein β is preferably about 95 degrees. In other embodiments, for example, x may be between about 1/16 in. and about ½ in. (e.g., about 1/16 in., about 3/16 in., about ¼ in., about 5/16 in., about ⅜ in., about 7/16 in., about ½ in.) and/or y may be between about 1/16 in. and about 5/16 in. (e.g., about 1/16 in., about 3/16 in., about ¼ in., about 5/16 in.). Additionally, in other embodiments, for example, β may be between about 90 and about 120 degrees (e.g., about 90 degrees, about 95 degrees, about 100 degrees, about 105 degrees, about 110 degrees, about 115 degrees, about 120 degrees). A notch 406 runs the entire length of magnet 400.

As shown in FIGS. 13B and 13BB, one embodiment of magnet 410 is an elongate thin flexible magnet with a substantially rectangular cross section. A first end of magnet 410 has a center tab 404. In this particular embodiment, center tab 404 has a length x and a width y, wherein x is preferably about ⅛ in. and wherein y is preferably about 3/32 in. The sides of center tab 404 are at an angle β, wherein β is preferably about 96 degrees. In other embodiments, for example, x may be between about 1/16 in. and about ½ in. (e.g., about 1/16 in., about 3/16 in., about ¼ in., about 5/16 in., about ⅜ in., about 7/16 in., about ½ in.) and/or y may be between about 1/16 in. and about 5/16 in. (e.g., about 1/16 in., about 3/16 in., about ¼ in., about 5/16 in.). Additionally, in other embodiments, β may be between about 90 and about 120 degrees (e.g., about 90 degrees, about 95 degrees, about 100 degrees, about 105 degrees, about 110 degrees, about 115 degrees, about 120 degrees). A second end of magnet 410 has a miter cut 402 at angle θ. In this particular embodiment, angle θ of miter cut 402 is about 45 degrees; however in other embodiments, for example, angle θ of miter cut may be between about 10 and about 80 degrees (e.g., about 10 degrees, about 20 degrees, about 30 degrees, about 40 degrees, about 50 degrees, about 60 degrees, about 70 degrees, about 80 degrees). A notch 406 runs the entire length of magnet 410.

As shown in FIGS. 13C and 1300, one embodiment of magnet 412 is an elongate thin flexible magnet with a substantially rectangular cross section. A first end of magnet 412 has a miter cut 402 at angle θ. In this particular embodiment angle θ of miter cut 402 is about 45 degrees; however in other embodiments, for example, angle θ of miter cut may be between about 10 and about 80 degrees (e.g., about 10 degrees, about 20 degrees, about 30 degrees, about 40 degrees, about 50 degrees, about 60 degrees, about 70 degrees, about 80 degrees). A second end of magnet 412 has an offset tab 408 wherein one side of offset tab 408 coincides with the long side of magnet 412. In this particular embodiment, offset tab 408 has a length x and a width y, wherein x is preferably about ⅛ in. and wherein y is preferably about 5/32 in. One side of offset tab 408 is at an angle β, wherein β is preferably about 95 degrees. In other embodiments, for example, x may be between about 1/16 in. and about ½ in. (e.g., about 1/16 in., about 3/16 in., about ¼ in., about 5/16 in., about ⅜ in., about 7/16 in., about ½ in.) and/or y may be between about 1/16 in. and about 5/16 in. (e.g., about 1/16 in., about 3/16 in., about ¼ in., about 5/16 in.). Additionally, in other embodiments, for example, β may be between 90 and 120 degrees (e.g., about 90 degrees, about 95 degrees, about 100 degrees, about 105 degrees, about 110 degrees, about 115 degrees, about 120 degrees). A notch 406 runs the entire length of magnet 412.

The miter cuts 402, center tabs 404 and offset tabs 408 correspond to and interface with tabs on the top and bottom gasket plugs in order to assist in ensuring that the polarities of the magnets are correct during manufacture and use. Referring now to FIGS. 14A-14D, 15A-15D, 16A-16D, and 17A-17E, certain embodiments of left top gasket plug 300*a*, left bottom gasket plug 310*a*, right top gasket plug 300*b* and right bottom gasket plug 310*b* are shown. Gasket plugs 300*a*, 310*a*, 300*b* and 310*b* are preferably comprised of substantially rigid polyvinyl chloride (PVC) that is black in color; however in other embodiments a variety of other materials may be used including, but not limited to, metal, plastic, wood, fiberglass, carbon fiber, or other composites. It is to be understood that colors other than black may also be used without departing from the scope of the present disclosure. In other embodiments, gasket plugs 300*a*, 310*a*, 300*b* and 310*b* may be comprised of flexible materials including, but not limited to, polyvinyl chloride (PVC), natural or synthetic rubber, or other suitable elastomer known in the art. Additionally, in this particular embodiment, gasket plugs 300*a*, 310*a*, 300*b* and 310*b* are each a single part. In other embodiments, for example, gasket plugs 300*a*, 310*a*, 300*b* and 310*b* may each be comprised of one or more parts. In such embodiments, gasket plugs 300*a*, 310*a*, 300*b* and 310*b* may have a first portion proximate to inner faces 45*a*, 45*b* of either the left or right door 41*a*, 41*b* that may be substantially hard and a second portion affixed opposite the first portion wherein the second portion may be softer or more flexible than the hard portion. Accordingly, when the left and right door assemblies 40*a*, 40*b* are closed past one another the second portions of gasket plugs 300*a*, 300*b*, 310*a*, 310*b* become proximate to one another, respectively, and can slightly deform, further assisting in reducing wiping or scrubbing of left and right gasket-to-gasket sealing surfaces 227*a*, 227*b*.

In particular, FIGS. 14A-14D show that, in one embodiment, left top gasket plug 300*a* is formed of a substantially flat plug body portion 301*a* with first and second sides. On first side of plug body portion 301*a* is a marking 302*a* which assists in correctly orienting left magnetic French door gasket assembly 200*a* on left door 41*a*. In this particular embodiment, marking 302*a* is shown as "L2"; however in other embodiments a variety of markings may be used including, but not limited to, tick marks, notches, letters, numbers, shapes, etc. Extending from the second side of plug body portion 301*a* is anterior tab 303*a* which is adapted to be inserted into anterior tab receiving chamber 224*a* of left extruded flexible gasket 201*a*. Also extending from the second side of plug body portion 301*a* is posterior tab 304*a* which is adapted to be inserted into posterior tab receiving chamber 230*a* of left extruded flexible gasket 201*a*. Anterior tab 303*a* and posterior tab 304*a* assist in maintaining the shape of left extruded flexible gasket 201*a* by reducing or eliminating mushrooming of the gasket wherein mushrooming is excessive movement or warping of the gasket material. By reducing or eliminating mushrooming, the anterior tab 303*a* and posterior tab 304*a* also reduce wiping or scrubbing of left and right gasket-to-gasket sealing surfaces 227*a*, 227*b*. Additionally extending from the second side of plug body portion 301*a* are three centrally notched tabs 306*a*, wherein the central notches of each tab 306*a* are adapted to receive the center tabs 404 of magnets 400, 410. Centrally notched tabs 306*a* assist in manufacturing left magnetic French door gasket assembly 200*a* by acting as a check or gauge for the orientation of magnets 400, 410. If magnets 400, 410 are placed incorrectly into left extruded flexible gasket 201*a*, left top gasket plug 300*a* will not fit properly into left extruded flexible gasket 201*a*.

Referring now to FIGS. 15A-15D, one particular embodiment is illustrated wherein left bottom gasket plug 310*a* is formed of a substantially flat plug body portion 311*a* with first and second sides. On first side of plug body portion 301*a* is a marking 312*a* which assists in correctly orienting left magnetic French door gasket assembly 200*a* on left door 41*a*. In this particular embodiment, marking 312*a* is shown as "L1"; however in other embodiments a variety of markings may be used including, but not limited to, tick marks, notches, letters, numbers, shapes, etc. Extending from the second side of plug body portion 311*a* is anterior tab 303*a* which is adapted to be inserted into anterior tab receiving chamber 224*a* of left extruded flexible gasket 201*a*. Also extending from the second side of plug body portion 311*a* is posterior tab 304*a* which is adapted to be inserted into posterior tab receiving chamber 230*a* of left extruded flexible gasket 201*a*. Anterior tab 303*a* and posterior tab 304*a* assist in maintaining the shape of left extruded flexible gasket 201*a* by reducing or eliminating mushrooming of the gasket wherein mushrooming is excessive movement or warping of the gasket material. By reducing or eliminating mushrooming, the anterior tab 303*a* and posterior tab 304*a* also reduce wiping or scrubbing of left and right gasket-to-gasket sealing surfaces 227*a*, 227*b*. Additionally extending from the second side of plug body portion 311*a* are three chamfered tabs 309*a*, wherein the chamfers of each tab 309*a* are adapted to receive the miter cuts 402 of magnets 400, 410. Chamfered tabs 309*a* assist in manufacturing left magnetic French door gasket assembly 200*a* by acting as a check or gauge for the orientation of magnets 400, 410. If magnets 400, 410 are placed incorrectly into left extruded flexible gasket 201*a*, left bottom gasket plug 310*a* will not fit properly into left extruded flexible gasket 201*a*.

Referring now to FIGS. 16A-16D, one particular embodiment is illustrated wherein right top gasket plug 300*b* is formed of a substantially flat plug body portion 301*b* with first and second sides. On first side of plug body portion 301*b* is a marking 302*b* which assists in correctly orienting right magnetic French door gasket assembly 200*b* on right door 41*b*. In this particular embodiment, marking 302*b* is shown as "R2"; however in other embodiments a variety of markings may be used including, but not limited to, tick marks, notches, letters, numbers, shapes, etc. Extending from the second side of plug body portion 301*b* is anterior tab 303*b* which is adapted to be inserted into anterior tab receiving chamber 224*b* of right extruded flexible gasket 201*b*. Also extending from the second side of plug body portion 301*b* is posterior tab 304*b* which is adapted to be inserted into posterior tab receiving chamber 230*b* of right extruded flexible gasket 201*b*. Anterior tab 303*b* and posterior tab 304*b* assist in maintaining the shape of right extruded flexible gasket 201*b* by reducing or eliminating mushrooming of the gasket wherein mushrooming is excessive movement or warping of the gasket material. By reducing or eliminating mushrooming, the anterior tab 303*b* and posterior tab 304*b* also reduce wiping or scrubbing of left and right gasket-to-gasket sealing surfaces 227*a*, 227*b*. Additionally extending from the second side of plug body portion 301*b* are three chamfered tabs 309*b*, wherein the chamfers of each tab 309*b* are adapted to receive the miter cuts 402 of magnets 410, 412. Chamfered tabs 309*b* assist in manufacturing right magnetic French door gasket assembly 200*b* by acting as a check or gauge for the orientation of magnets 410, 412. If magnets 410, 412 are placed incorrectly into right extruded flexible gasket 201*b*, right top gasket plug 300*b* will not fit properly into right extruded flexible gasket 201*b*.

Referring now to FIGS. 17A-17D, one particular embodiment is illustrated wherein right bottom gasket plug 310*b* is formed of a substantially flat plug body portion 311*b* with first and second sides. On first side of plug body portion 311*b* is a marking 312*b* which assists in correctly orienting right magnetic French door gasket assembly 200*b* on right door 41*b*. In this particular embodiment, marking 312*b* is shown as "R1"; however in other embodiments a variety of markings may be used including, but not limited to, tick marks, notches, letters, numbers, shapes, etc. Extending from the second side of plug body portion 311*b* is anterior tab 303*b* which is adapted to be inserted into anterior tab receiving chamber 224*b* of right extruded flexible gasket 201*b*. Also extending from the second side of plug body portion 311*b* is posterior tab 304*b* which is adapted to be inserted into posterior tab receiving chamber 230*b* of right extruded flexible gasket 201*b*. Anterior tab 303*b* and posterior tab 304*b* assist in maintaining the shape of right extruded flexible gasket 201*b* by reducing or eliminating mushrooming of the gasket wherein mushrooming is excessive movement or warping of the gasket material. By reducing or eliminating mushrooming, the anterior tab 303*b* and posterior tab 304*b* also reduce wiping or scrubbing of left and right gasket-to-gasket sealing surfaces 227*a*, 227*b*. Additionally extending from the second side of plug body portion 311*b* are one centrally notched tab 306*b* and two side notched tabs 307*b*, wherein the central and side notches of each tab 306*b*, 307*b* are adapted to receive the center and offset tabs 404, 408 of magnets 410, 412, respectively. Central and side notched tabs 306*b*, 307*b* assist in manufacturing right magnetic French door gasket assembly 200*b* by acting as a check or gauge for the orientation of magnets 410, 411. If magnets 410, 412 are placed incorrectly into right extruded flexible gasket 201*b*, right bottom gasket plug 310*b* will not fit properly into right extruded flexible gasket 201*b*.

Having described the components of Left and right French door magnetic gasket assemblies 200*a*, 200*b*, each left and right French door magnetic gasket assemblies 200*a*, 200*b* may be constructed by inserting magnets 400, 410 and/or 412 into their respective chambers 210, 212 and 214. Top and bottom left and right gasket plugs 300*a*, 300*b*, 310*a*, 310*b* are then inserted into and secured to left and right French door gaskets 201*a*, 201*b*, respectively. Preferably, in one particular embodiment, top and bottom gasket plugs 300*a*, 300*b*, 310*a*, 310*b* are secured to left and right French door gaskets 201*a*, 201*b* using silicone adhesive; however in other embodiments other adhesives may be used including, but not limited to, PVC cement, epoxy, rubber cement, cyanoacrylate, hot glue or any other adhesive known in the art. In yet other embodiments, for example, top and bottom gasket plugs 300*a*, 300*b*, 310*a*, 310*b* may be welded to left and right French door gaskets 201*a*, 201*b* through the use of plastic welding techniques known in the art including, but not limited to, hot gas welding, heat sealing, extrusion welding, hot plate welding, ultrasonic welding, solvent welding, laser welding, etc.

Although various embodiments of magnets and gasket plugs including a variety of miter cuts, notches and tabs have been described herein, in other embodiments, magnets 400, 410, 412 may not include any miter cuts or tabs and gasket plugs 300*a*, 300*b*, 310*a*, 310*b* may be identical. In these particular embodiments, for example, the first and second ends of magnets 400, 410, 412 may be cut perpendicular to the length of magnets 400, 410, 412. Additionally, the tabs of gasket plugs 300*a*, 300*b*, 310*a*, 310*b* may not have any miter cuts or notches, but instead the ends of the tabs may be straight to interface with the straight ends of magnets 400, 410, 412. Accordingly, in certain embodiments, a single type of gasket plug may be used for top and bottom and left and right magnetic French door gasket assemblies 200*a*, 200*b* (i.e., the single type gasket plug is not unique to each of the top and bottom and left and right magnetic French door gasket assemblies 200*a*, 200*b*). A method or device to check the polarity of magnets 400, 410, 412 as inserted into left and right French door gaskets 201*a*, 201*b* may then be used to ensure that magnets 400, 410, 412 are oriented correctly during manufacture of left and right magnetic French door gasket assemblies 200*a*, 200*b*. This embodiment, therefore does not rely on the miter cuts, tabs or notches in magnets 400, 410, 412 and gasket plugs 300*a*, 300*b*, 310*a*, 310*b* for correct orientation of magnets 400, 410, 412.

Figure 18:
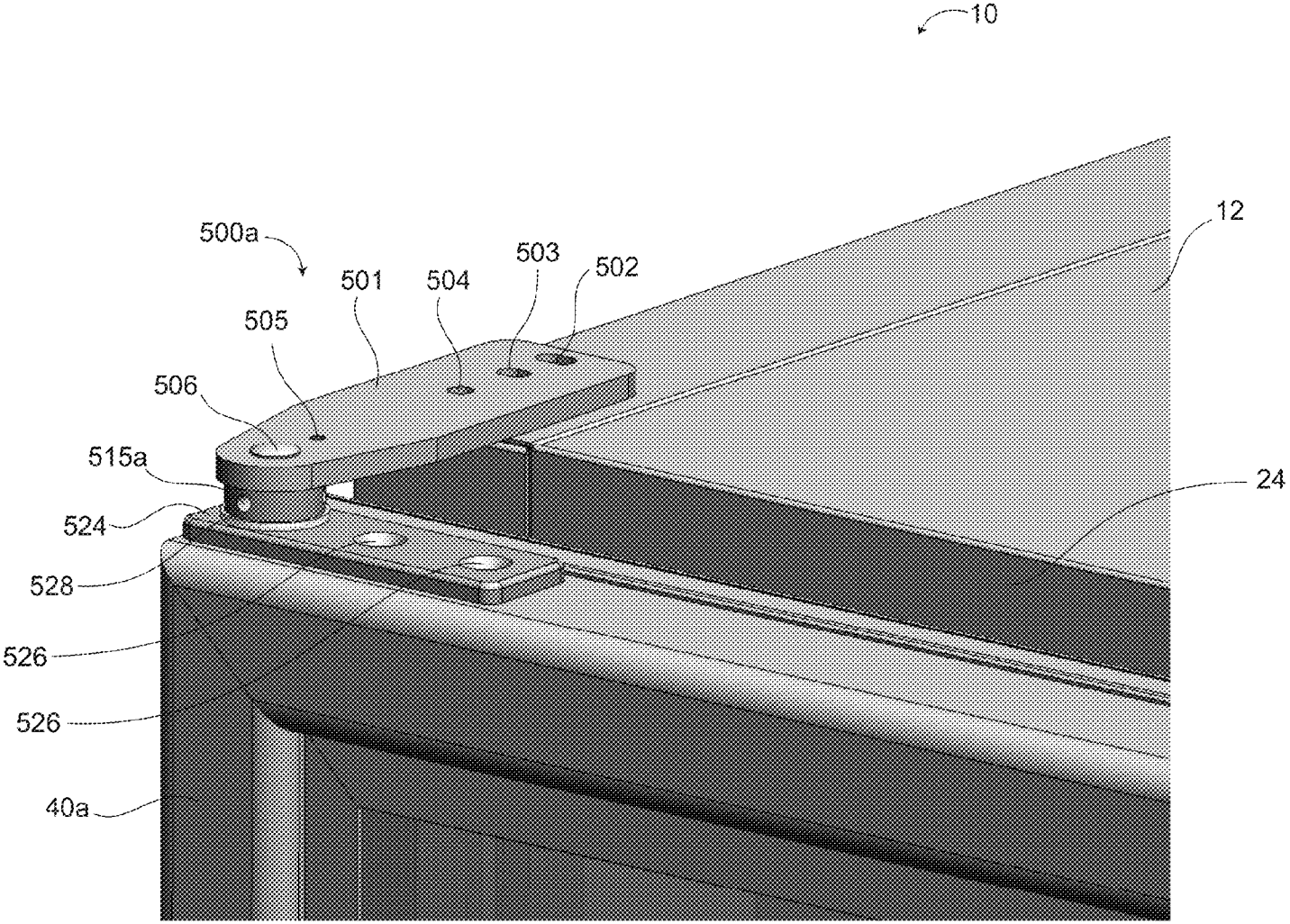
FIG. 18 is a right perspective view of an adjustable top left hinge assembly according to one embodiment of the present invention.
Figure 19A:
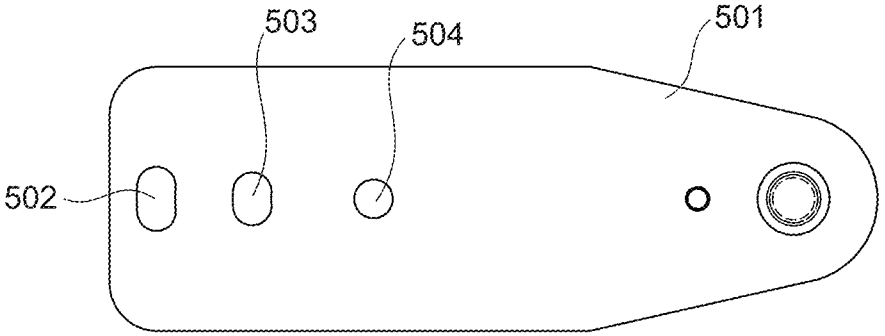
FIG. 19A is a top view of an adjustable top left hinge bracket according to one embodiment of the present invention.
Figure 19B:
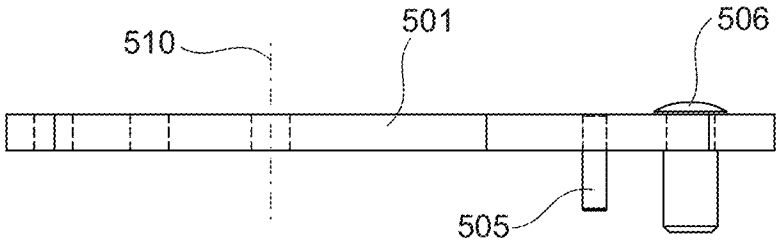
FIG. 19B is a front plan view of an adjustable top left hinge bracket according to one embodiment of the present invention.

Referring again to FIG. 3, left and right French door assemblies 40*a*, 40*b* are rotatably affixed to cabinet 12 by adjustable top left hinge assembly 500*a*, top right hinge assembly 500*b* and bottom right hinge brackets 550. Shown in more detail in FIG. 18, is one embodiment of adjustable top left hinge assembly 500*a*, which includes adjustable top left hinge bracket 501, spring cartridge assembly 515*a* and top hinge door bracket 524. Furthermore, in this particular embodiment as illustrated in FIGS. 19A and 19B, adjustable top left hinge bracket 501 is formed of a substantially flat plate having two slots 502 and 503 and hole 504 through which screws (not shown) can be inserted through and into cabinet 12 thereby securing adjustable top left hinge assembly 500*a* to cabinet 12. Slots 502 and 503 permit adjustment of the position of adjustable top left hinge assembly 500*a* to ensure that left and right French door assemblies 40*a* and 40*b* close correctly. As discussed in more detail elsewhere herein, screws are inserted through hole 504 and slots 502, 503 and while the screws are not fully tightened, adjustable top left hinge bracket 501 can be rotated slightly about a central axis 510 of hole 504. As seen in FIGS. 18 and 19A, slot 502 is slightly wider than slot 503 which, because slot 502 is a further distance away from hole 504 than slot 503 is from hole 504, the extra width of slot 502 permits more rotation about the central axis 510 of hole 504 than if slots 502 and 503 were equal in width. Adjustable top left hinge bracket 501 further includes spring cartridge engaging pin 505 and hinge pin 506.

Figure 20:
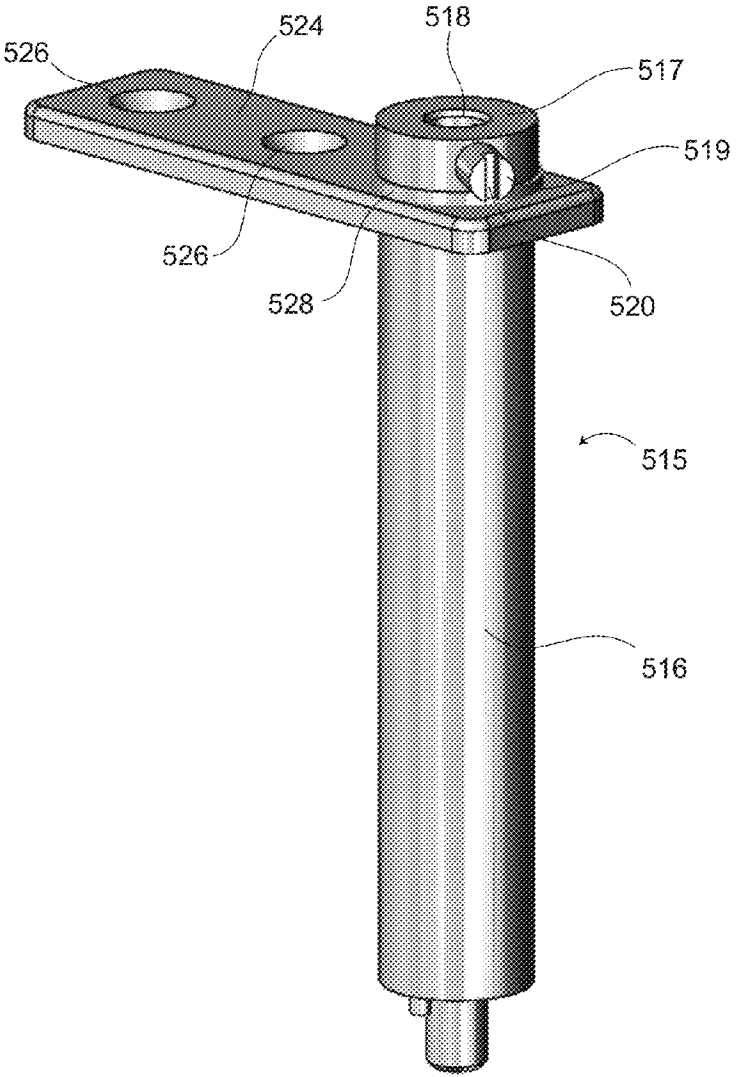
FIG. 20 is a right perspective view of a spring cartridge assembly and a top hinge door bracket according to one embodiment of the present invention.

Referring now to FIG. 20, one embodiment of spring cartridge assembly 515 is illustrated, wherein spring cartridge assembly 515 includes substantially cylindrical spring cartridge body 516 which houses a spring (not shown) and a rotatable top portion 517, wherein the spring provides a spring force to close left French door assembly 40*a* in a counterclockwise direction (as viewed from the top of refrigerator cooler 10). At the top end of rotatable top portion 517 is hinge pin receiving hole 518 which is adapted to receive hinge pin 506 of adjustable top left hinge bracket 501. Extending radially from near rotatable top portion 517 is pin engaging arm 519 which includes a pin engaging slot 520 which is adapted to receive spring cartridge engaging pin 505; pin engaging arm 519 transfers the spring force of the spring (not shown) to the adjustable top left hinge bracket via spring cartridge engaging pin 505 to close the door. Additionally illustrated in FIG. 20 is one embodiment of top hinge door bracket 524. Top hinge door bracket 524 if formed of a substantially flat plate having two holes 526 and spring cartridge receiving hole 528. In this particular embodiment, spring cartridge assembly 515*a* is secured to top hinge door bracket 524 in spring cartridge receiving hole 528 such that rotatable top portion 517 can rotate while spring cartridge body 516 is fixed in position. In certain embodiments, spring cartridge assembly 515*a* may be press fit inside spring cartridge receiving hole 528, while in other embodiments spring cartridge assembly 515*a* may be secured to top hinge door bracket 524 in a variety of ways including, but not limited to, screws, rivets, adhesives, welds, brazing, etc. Adjustable top left hinge assembly 500*a* permits rotation of left French door assembly 40*a* clockwise while being opened by a user and spring cartridge assembly 515*a* acts to close the door once the user releases the door.

Figure 21:
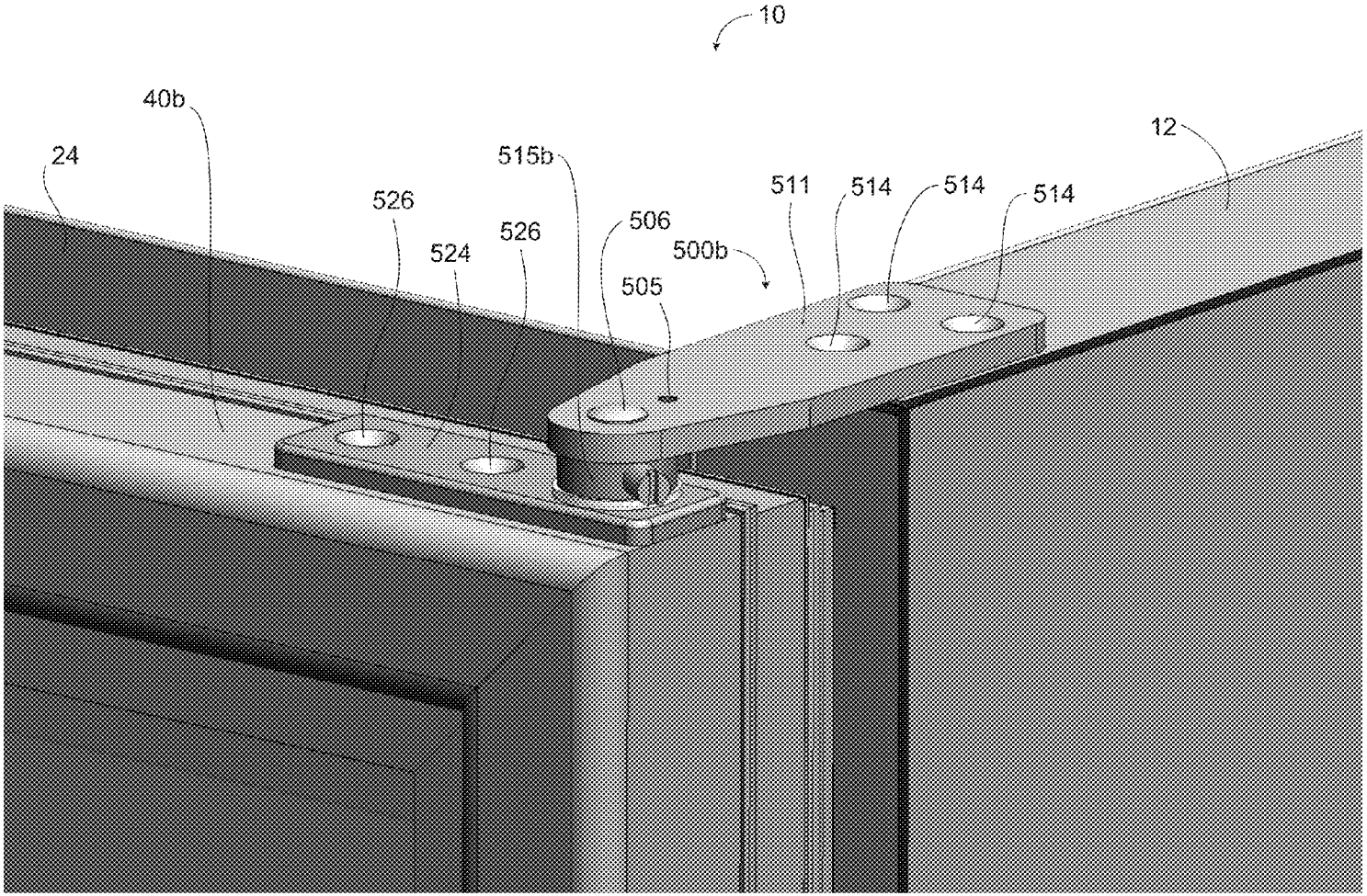
FIG. 21 is a right perspective view of an top right hinge assembly according to one embodiment of the present invention.
Figure 22A:
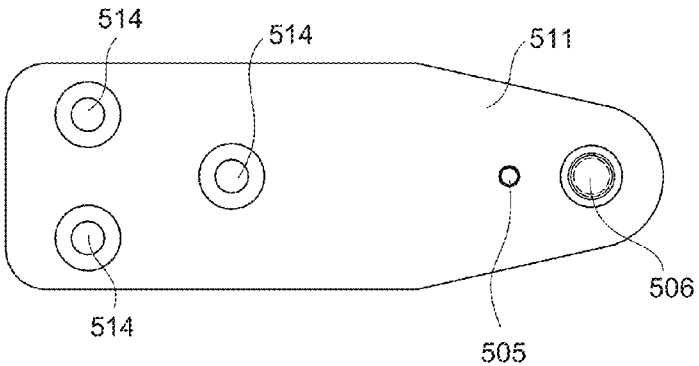
FIG. 22A is a top view of a top right hinge bracket according to one embodiment of the present invention.
Figure 22B:
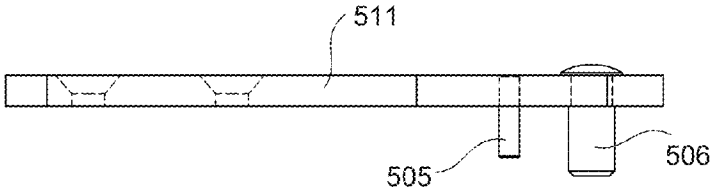
FIG. 22B is a front plan view of a top right hinge bracket according to one embodiment of the present invention.
Figure 22C:
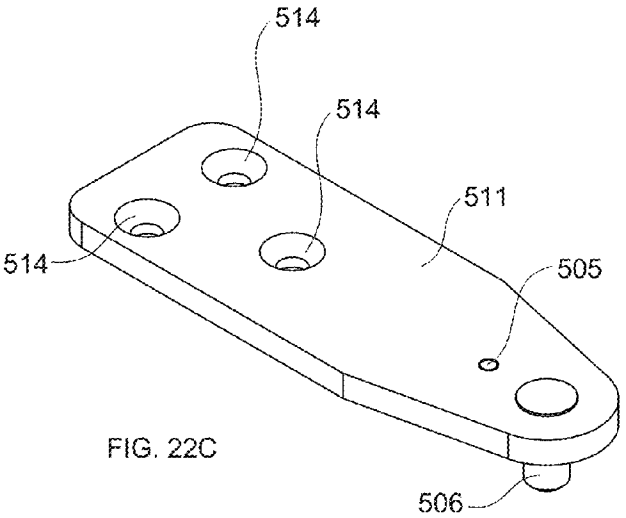
FIG. 22C is a left perspective view of a top right hinge bracket according to one embodiment of the present invention.

FIG. 21 illustrates one embodiment of top right hinge assembly 500*b*, which includes top right hinge bracket 511, spring cartridge assembly 515*b* and top hinge door bracket 524. Furthermore, in this particular embodiment, top right hinge bracket 511 is formed of a substantially flat plate having three holes 514, spring cartridge engaging pin 505 and hinge pin 506 (as shown in detail in FIGS. 22A, 22B and 22C). Screws (not shown) can be inserted through holes 514 and into cabinet 12 thereby securing top right hinge assembly 500*b* to cabinet 12. Top hinge door bracket 524 is the same as top hinge door bracket of adjustable top left hinge assembly 500*a*. Furthermore, spring cartridge 515*b* is substantially the same as spring cartridge 515*a*, except the spring (not shown) provides a spring force to close right French door assembly 40*b* in a clockwise direction (as viewed from the top of refrigerator cooler 10). Accordingly, top right hinge assembly 500*b* permits rotation of right French door assembly 40*b* counterclockwise while being opened by a user and spring cartridge assembly 515*b* acts to close the door once the user releases the door.

Figure 23:
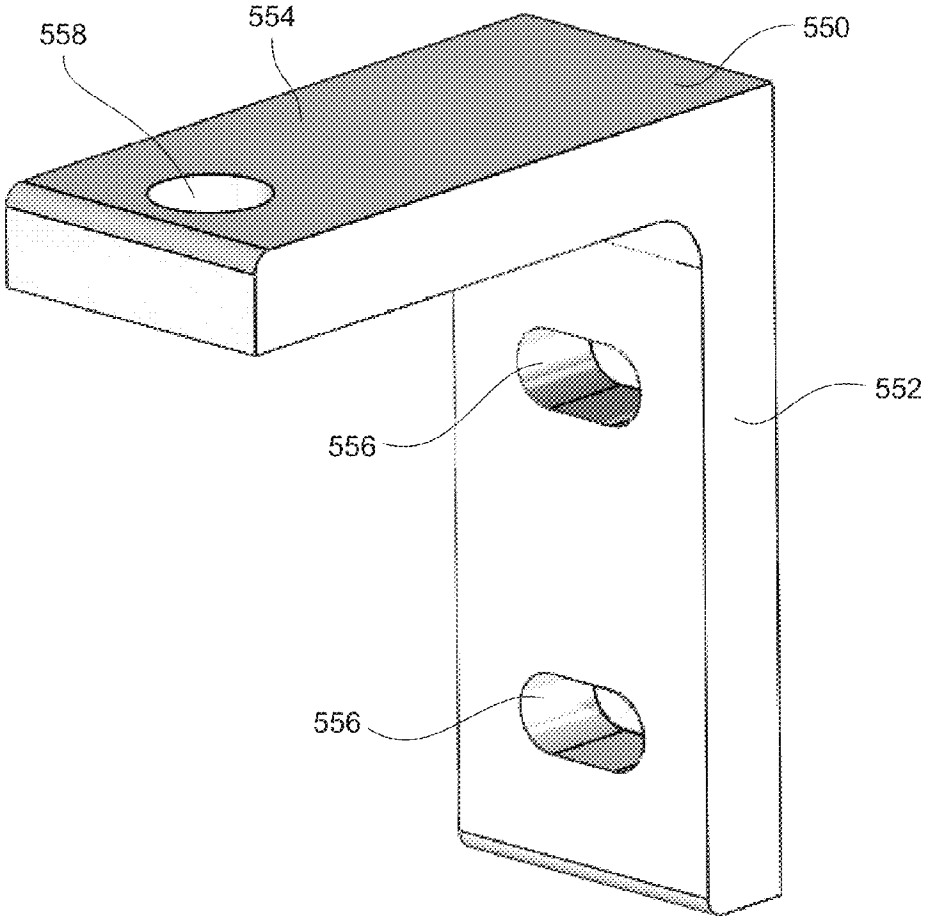
FIG. 23 is a right perspective view of a bottom hinge bracket according to one embodiment of the present invention.

One embodiment of bottom hinge brackets 550 is illustrated in FIG. 23. Bottom hinge bracket 550 includes a substantially vertical bracket portion 552 connected at substantially a 90 degree angle to a substantially horizontal bracket portion 554. Substantially vertical bracket portion 552 of bottom hinge bracket 550 includes substantially horizontal slots 556 through which screws (not shown) can be inserted through and into cabinet 12 thereby securing bottom hinge bracket 550 to cabinet 12. Slots 556 permit adjustment of the position of bottom hinge bracket 550 to ensure that left and right French door assemblies 40*a*, 40*b* close correctly. Substantially horizontal bracket portion 554 of bottom hinge bracket 550 includes hole 558 which is adapted to receive bottom hinge pins (not shown) which are inserted into bushings (not shown) in bottom faces 47*a*, 47*b* of left and right doors 41*a*, 41*b*. Bottom hinge pins may be slotted or may include a through hole to permit one or more wires to be inserted in or threaded through the bottom hinge pins. During installation, a thrust washer may be placed on each bottom hinge pin prior to securing the bottom hinge bracket 550 to cabinet 12 which may assist in the rotation of left and right door assemblies 40*a*, 40*b*. The bushings (not shown) in bottom faces 47*a*, 47*b* of left and right doors 41*a*, 41*b*, in one embodiment may be comprised of bronze; however in other embodiments, the bushings may be comprised of a variety of metals including, but not limited to, brass, copper, steel, stainless steel, aluminum, titanium, and/or other pure metals or metal alloys. In yet other embodiments, for example, the bushings may be comprised of a variety of other materials including, but not limited to, plastics or other polymers or composites. FIG. 3 illustrates bottom hinge brackets 550 as installed on cabinet 12.

While the adjustable top left hinge assembly 500*a*, top right hinge assembly 500*b* and bottom right hinge brackets 550 have been described in detail herein, any commercially available hinge assembly or hinge type known in the art may be used. Therefore it is to be understood that different hinge constructions may be used without departing from the scope of the present disclosure.

While removing the center vertical mullion from a refrigerator cooler allows for the storage and display of additional products for sale, it was found that with the support of the center vertical mullion removed the left and right French doors would not properly close. The springs in the top left and right hinge assemblies 500*a*, 500*b* caused the left and right door back faces 43*a*, 43*b* of left and right French door assemblies 40*a*, 40*b* to not close parallel to cabinet front face 24. Repeated closures of left and right French door assemblies 40*a*, 40*b* at an angle to cabinet front face 24 would cause mushrooming or deformation of left and right magnetic French door assemblies 200*a*, 200*b*. The mushrooming or deformation would prevent left and right French door assemblies 40*a*, 40*b* from closing and would also prevent the left and right magnetic French door assemblies 200*a*, 200*b* from sealing, thus reducing or eliminating the ability to maintain a low temperature in the refrigerator cooler. Therefore, in one embodiment as illustrated in FIGS. 1, 2, 4A, 4B, 5A, 5B and 6, to ensure that the left and right door back faces 43*a*, 43*b* of left and right French door assemblies 40*a*, 40*b* close parallel to cabinet front face 24, door stop assemblies 600 are attached to the top and bottom of left and right doors 41*a*, 41*b* near the left and right door inner faces 45*a*, 45*b*. In this particular embodiment as shown in more detail in FIG. 6, door stop assemblies 600 include door stop bracket 602 and door stop bumper 604, wherein one doorstop bracket 602 is affixed to the top of left door 41*a* and one doorstop bracket 602 is affixed to the top of right door 41*b*. In certain embodiments, doorstop bracket may be affixed to left door top and bottom frame members 49*a*, 51*a* and right door top and bottom frame members 49*b*, 51*b* while in other embodiments doorstop bracket may be affixed to left door top and bottom gasket retainers 60*a*, 64*a* and right door top and bottom gasket retainers 60*b*, 64*b*. Doorstop bracket 602 may be affixed to any of these elements via a variety of means including, but not limited to, screws, rivets, adhesives, welds, brazing, etc. Doorstop bumper 604 is preferably comprised of silicone that is black in color; however in other embodiments a variety of other materials may be used including, but not limited to, natural or synthetic rubber, felt, cork, or other suitable shock absorbing material known in the art. It is to be understood that colors other than black may also be used without departing from the scope of the present disclosure. Doorstop bumper 604 may be affixed to doorstop bracket 602 via a variety of means including, but not limited to, press fit, screws, rivets, adhesives, etc.

Figures 24A, 24B:
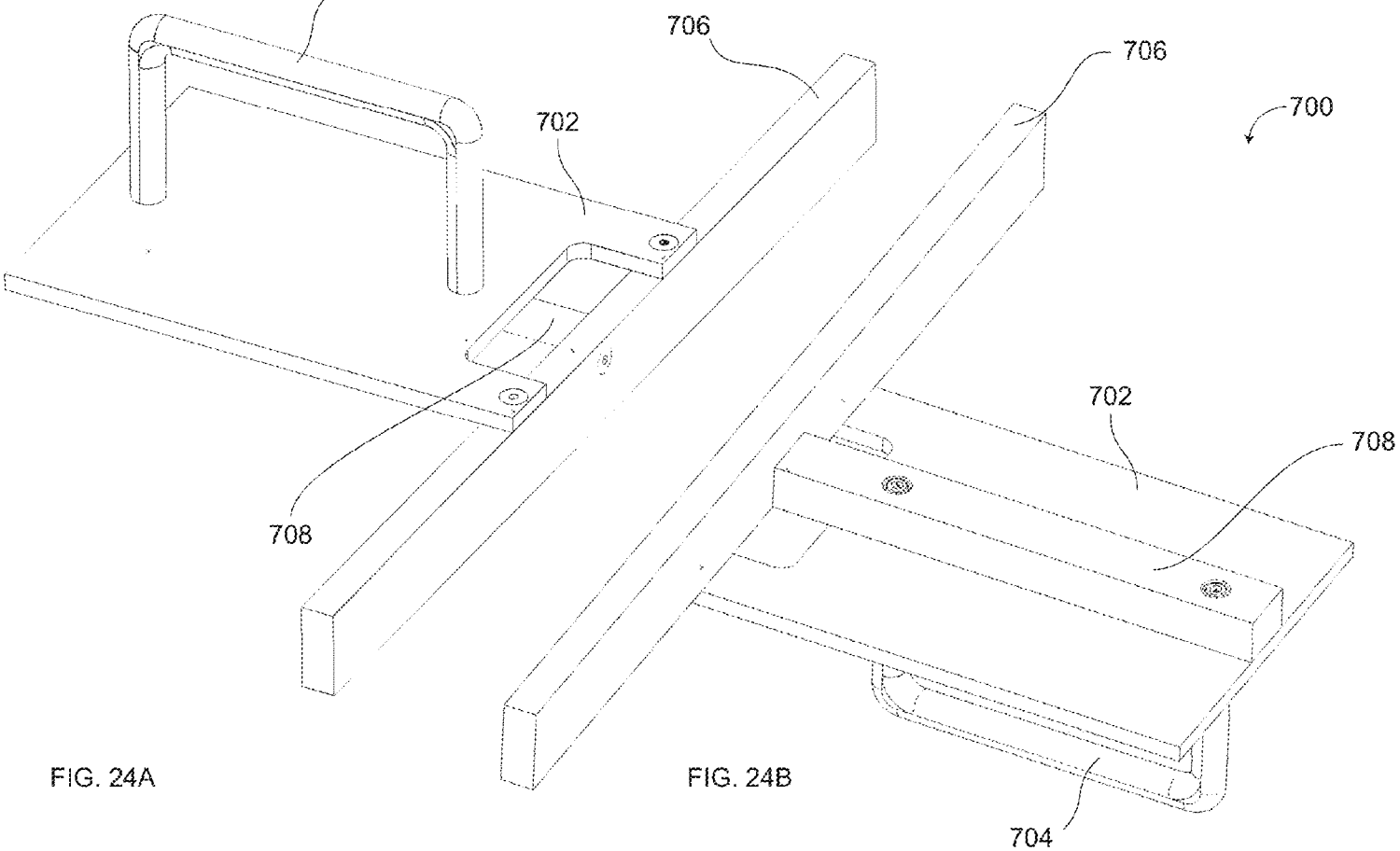
FIG. 24A is a left top perspective view of a T door fixture according to one embodiment of the present invention.
FIG. 24B is a left bottom perspective view of a T door fixture according to one embodiment of the present invention.

During one embodiment of manufacturing refrigerator cooler 10 as described herein, various fixtures are used to assist in correct placement of the various assemblies that form refrigerator cooler 10. As shown in FIGS. 24A and 24B, one embodiment of a T door fixture 700 is shown. T door fixture 700 is formed of a substantially rectangular fixture plate 702 having a first and second side, a top and a bottom edge. Affixed to the first side of fixture plate 702 is handle 704 which may be used to place and remove T door fixture 700, affixed to the second side of fixture plate 702 along the top edge of fixture plate 702 is top bar 706. Also affixed to the second side of fixture plate 702 and orthogonal to top bar 706 is door gap fixture bar 708. During installation of left and right door assemblies 40*a* and 40*b*, two T door fixtures may be placed at the top and bottom of left and right door assemblies 40*a* and 40*b* to ensure the correct gap between left and right door assemblies 40*a* and 40*b* and the correct placement on cabinet 12, as described more fully elsewhere herein. In one embodiment, door gap fixture bar 708 ensures that the gap between inner faces 45*a*, 45*b* of left and right doors 41*a*, 41*b* is about 15/16 in. In other embodiments, door gap fixture bar 708 may ensure that the gap between inner faces 45*a*, 45*b* of left and right doors 41*a*, 41*b* is between about ½ in. and about 1 in. (e.g., about ½ in., about ⅝ in., about ¾ in., about ⅞ in., about 15/16 in., about 1 in.).

Figure 25C:
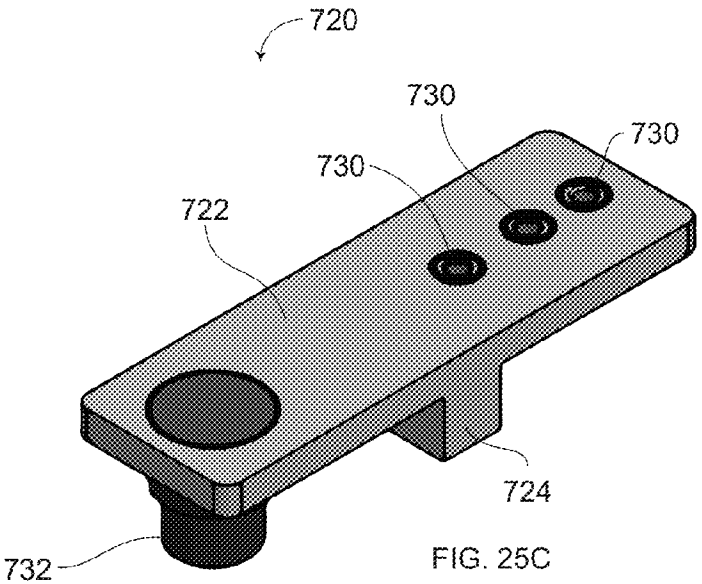
FIG. 25C is a right perspective view of a top left hinge fixture assembly according to one embodiment of the present invention.
Figure 25B:
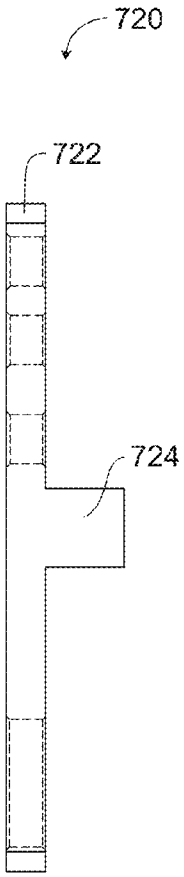
FIG. 25B is a right plan view of a top left hinge fixture assembly according to one embodiment of the present invention.
Figure 25A:
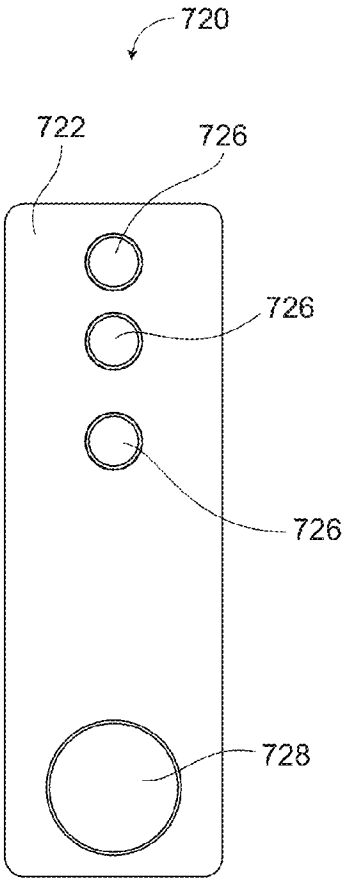
FIG. 25A is a top view of a top left hinge fixture assembly according to one embodiment of the present invention.

Referring now to FIGS. 25A, 25B and 25C, one embodiment of a top left hinge fixture assembly 720 is illustrated. In this particular embodiment, top left hinge fixture assembly 720 includes a substantially rectangular top left hinge fixture plate 722 having three holes 726 located collinearly near a top edge of top left hinge fixture plate 722, wherein each of the three holes 726 may be adapted to receive a drill bushing 730. Top left hinge fixture plate 722 further includes hole 728 located collinearly with three holes 726 near a bottom edge of top left hinge fixture plate 722, wherein hole 728 is adapted to receive a locator pin 732 which extends orthogonal from a bottom face of top left hinge fixture plate 722. Extending orthogonal from a bottom face of top left hinge fixture plate 722 is locator rib 724. Locator rib 724 additionally acts as a spacer between the left door assembly 40*a* and cabinet front face 24 during installation of left door assembly 40*a* which assists in correctly locating holes 726 on cabinet 12 (see FIG. 30B). Locator rib 724 therefore ensures that when adjustable top left hinge bracket 501 is secured to cabinet 12, the positioning of left door assembly 40*a* with respect to cabinet front face 24 is correct so that when left door assembly 40*a* is closed, perimeter gasket 100*a* properly seals against a portion of cabinet front face 24. If the distance were not correct between left door assembly 40*a* and cabinet front face 24, perimeter gasket 100*a* may not seal properly or at all. While this particular embodiment of top left hinge fixture assembly 720 includes drill bushings 730 in holes 726, in other embodiments top left hinge fixture assembly 720 may not include drill bushings 730 in holes 726. Additionally, in certain embodiments, top left hinge fixture plate 722, locator pin 732 and locator rib 724 may comprise individual parts affixed to one another, while in other embodiments some or all of top left hinge fixture plate 722, locator pin 732 and locator rib 724 may comprise a unitary part (e.g., machined from or cast in one part). During installation of left door assembly 40*a*, top left hinge fixture assembly 720 may be placed at the top of left door assembly 40*a* to ensure the correct placement of screw locations for adjustable top left hinge assembly 500*a* on cabinet 12, as described more fully elsewhere herein.

Figure 26C:
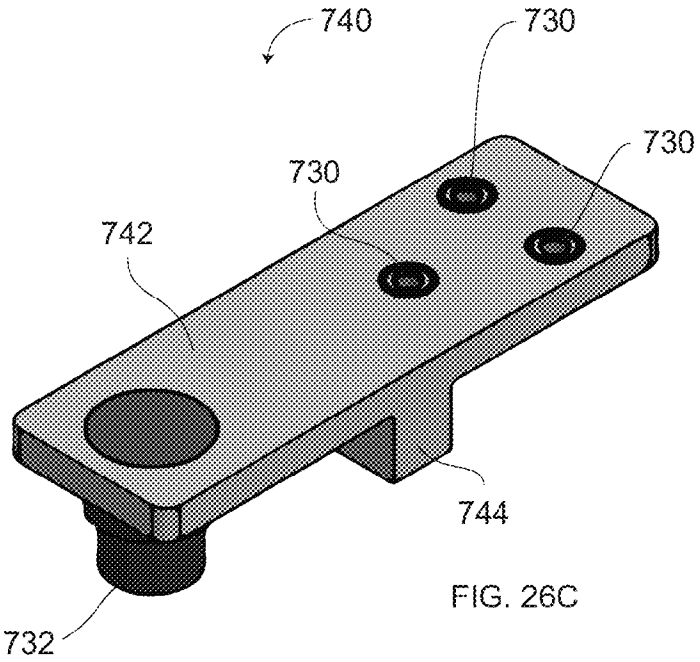
FIG. 26C is a right perspective view of a top right hinge fixture assembly according to one embodiment of the present invention.
Figure 26B:
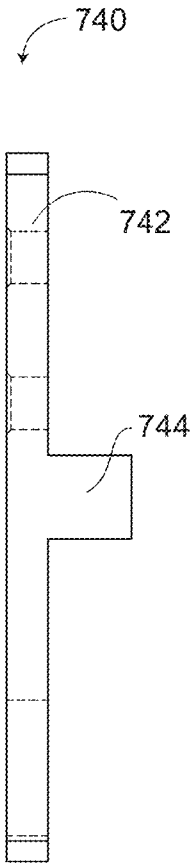
FIG. 26B is a right plan view of a top right hinge fixture assembly according to one embodiment of the present invention.
Figure 26A:
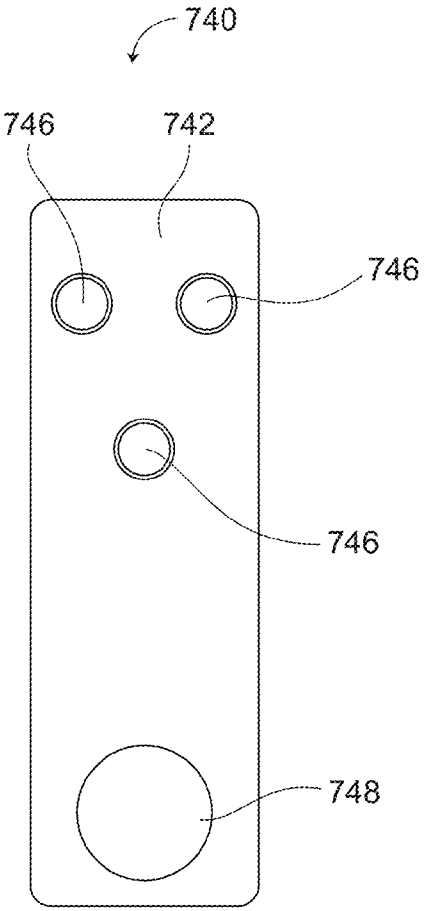
FIG. 26A is a top view of a top right hinge fixture assembly according to one embodiment of the present invention.

Referring now to FIGS. 26A, 26B and 26C, one embodiment of a top right hinge fixture assembly 740 is illustrated. In this particular embodiment, top right hinge fixture assembly 740 is formed of a substantially rectangular top right hinge fixture plate 742 having three holes 746 located in a triangular pattern near a top edge of top right hinge fixture plate 742, wherein each of the three holes 746 may be adapted to receive a drill bushing 730. It is to be understood that in other embodiments, holes 746 may be located in any particular pattern, including collinearly, L-shaped, etc. without departing from the scope of the present disclosure. Top right hinge fixture plate 742 further includes hole 748 located near a bottom edge of top right hinge fixture plate 742, wherein hole 748 is adapted to receive a locator pin 732 which extends orthogonal from a bottom face of top right hinge fixture plate 742. Also extending orthogonal from a bottom face of top right hinge fixture plate 742 is locator rib 744. Locator rib 744 additionally acts as a spacer between right door assembly 40*b* and cabinet front face 24 during installation of right door assembly 40*b* which assists in correctly locating holes 726 on cabinet 12 (see FIG. 30A). Locator rib 744 therefore ensures that when top right hinge bracket 511 is secured to cabinet 12, the positioning of right door assembly 40*b* with respect to cabinet front face 24 is correct so that when right door assembly 40*b* is closed, perimeter gasket 100*b* properly seals against a portion of cabinet front face 24. If the distance were not correct between right door assembly 40*b* and cabinet front face 24, perimeter gasket 100*b* may not seal properly or at all. While this particular embodiment of top right hinge fixture assembly 740 includes drill bushings 730 in holes 746, in other embodiments top right hinge fixture assembly 740 may not include drill bushings 730 in holes 746. Additionally, in certain embodiments, top right hinge fixture plate 742, locator pin 732 and locator rib 744 may comprise individual parts affixed to one another, while in other embodiments some or all of top right hinge fixture plate 742, locator pin 732 and locator rib 744 may comprise a unitary part (e.g., machined from or cast in one part). During installation of right door assembly 40*b*, top right hinge fixture assembly 740 may be placed at the top of right door assembly 40*b* to ensure the correct placement of screw locations for top right hinge assembly 500*b* on cabinet 12, as described more fully elsewhere herein.

Figure 27A:
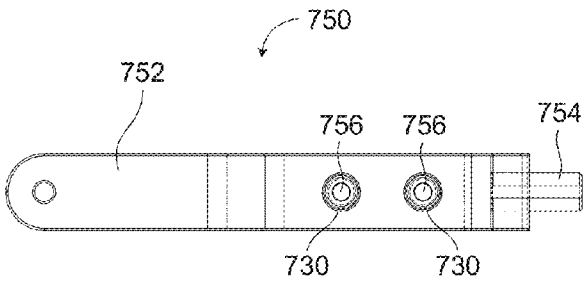
FIG. 27A is a front plan view of a bottom hinge fixture assembly according to one embodiment of the present invention.
Figure 27B:
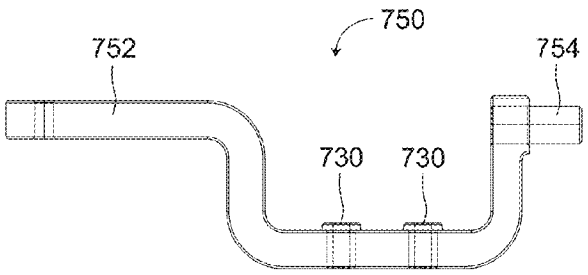
FIG. 27B is a right plan view of a bottom hinge fixture assembly according to one embodiment of the present invention.
Figure 27C:
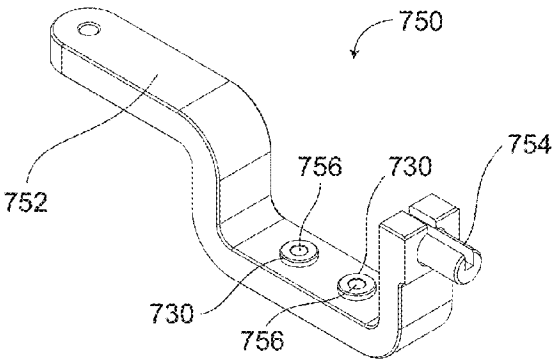
FIG. 27C is a right perspective view of a bottom hinge fixture assembly according to one embodiment of the present invention.

In FIGS. 27A, 27B and 27C, one embodiment of a bottom hinge fixture assembly 750 is shown. Bottom hinge fixture assembly 750 is formed of a substantially U-shaped bottom hinge fixture plate 752 having two holes 756 located collinearly near the bottom of the U-shaped bottom hinge fixture plate 752, wherein each of the two holes 756 may be adapted to receive a drill bushing 730. Bottom hinge fixture assembly 750 further includes a slotted locator pin 754 extending perpendicular from one leg of the U-shaped bottom hinge fixture plate 752, wherein slotted locator pin 754 is also oriented perpendicular to holes 756. While this particular embodiment of bottom hinge fixture assembly 750 includes drill bushings 730 in holes 756, in other embodiments bottom hinge fixture assembly 750 may not include drill bushings 730 in holes 756. Additionally, in certain embodiments, bottom hinge fixture plate 752 and slotted locator pin 754 may comprise individual parts affixed to one another, while in other embodiments bottom hinge fixture plate 752 and slotted locator pin 754 may comprise a unitary part (e.g., machined from or cast in one part). During installation of left and right door assemblies 40*a* and 40*b*, a bottom hinge fixture assembly 750 may be placed at the bottom of left door assembly 40*a* and a bottom hinge fixture assembly 750 may be placed at the bottom of right door assembly 40*b* to ensure the correct placement of screw locations for bottom hinge brackets 550 on cabinet 12, as described more fully elsewhere herein.

Figure 28:
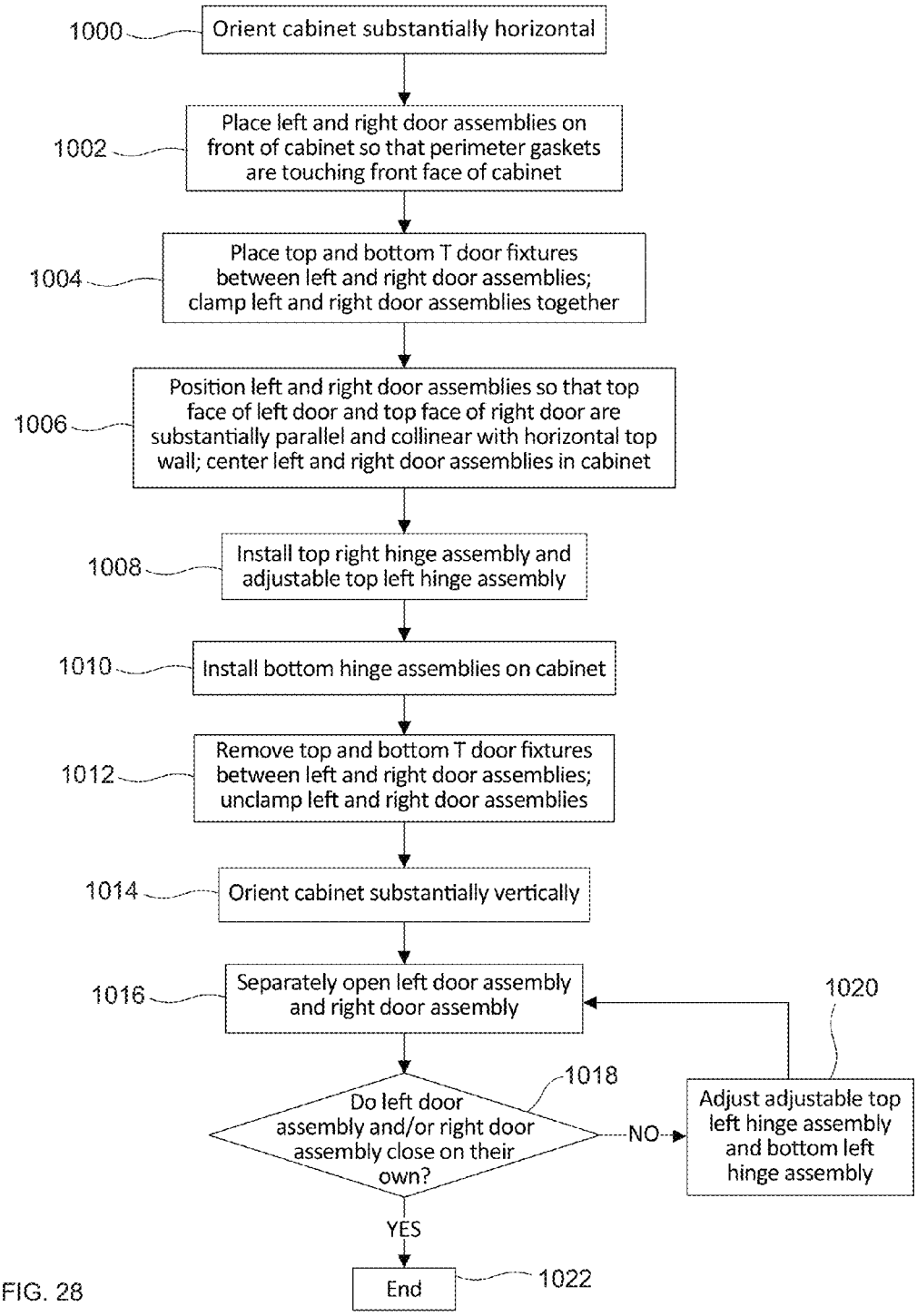
FIG. 28 is a flow chart of one method of installing French doors on a cooler according to one embodiment of the present invention.
Figure 29A:
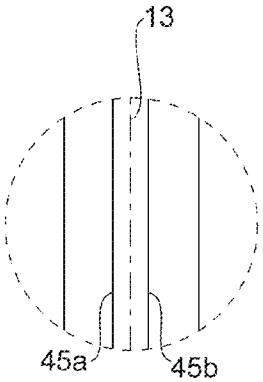
FIG. 29A is a detail front plan view of one method of installing French doors on a cooler according to one embodiment of the present invention.
Figure 29:
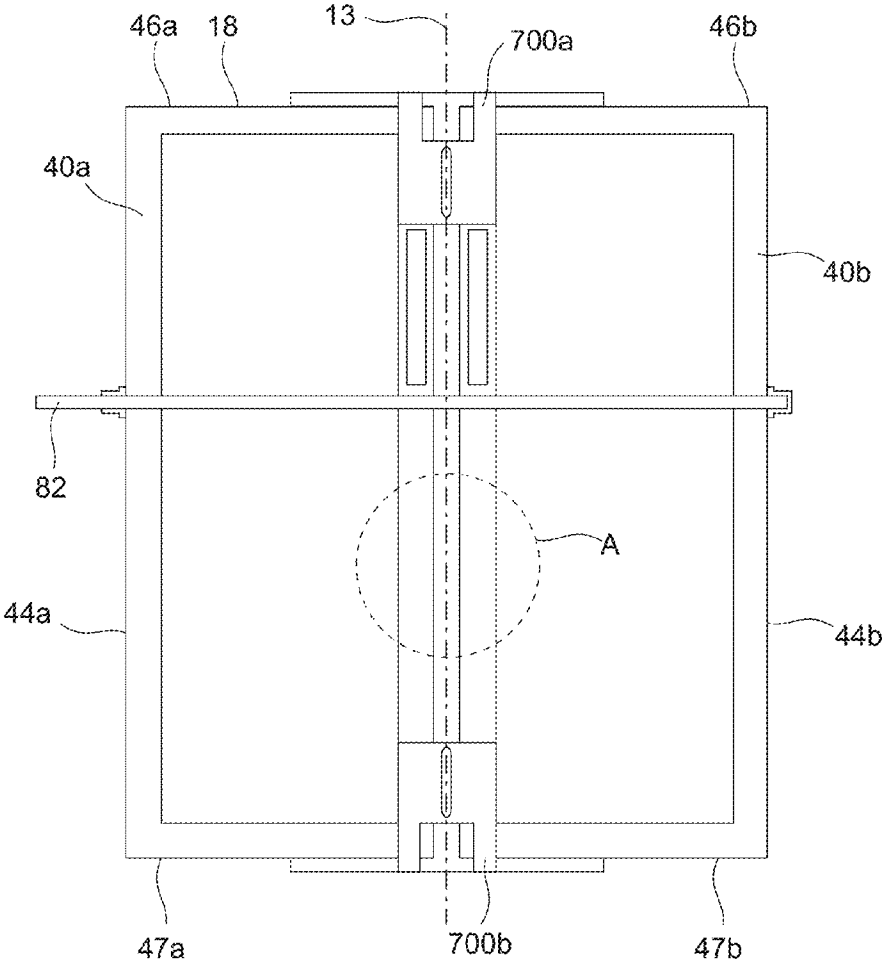
FIG. 29 is a front plan view of one method of installing French doors on a cooler according to one embodiment of the present invention.

Referring now to FIG. 28, one embodiment of manufacturing refrigerator cooler 10 having French doors is illustrated. This particular method focuses on the installation of the French doors to the cabinet and, as such, there may be additional steps prior to and after installation of the French doors to the cabinet. After construction of certain parts of cabinet 12, at step 1000 cabinet 12 is oriented in a substantially horizontal position such that cabinet front face 24 is facing substantially vertically upward. At step 1002 the left and right door assemblies 40*a*, 40*b* are placed on the open front of cabinet 12 so that the perimeter gaskets 100*a*, 100*b* are touching cabinet front face 24. Then at step 1004, a top T door fixture 700*a* and bottom T door fixture 700*b* are placed between the left and right door assemblies 40*a*, 40*b* and at least one clamp 82 is spread across left and right door assemblies 40*a*, 40*b* and clamped against outer face 44*a* of left door 41*a* and outer face 44*b* of right door 41*b*, thereby clamping the left and right door assemblies 40*a*, 40*b* together (see FIG. 29). The top and bottom T door fixtures 700*a* and 700*b* ensure that, during installation, inner face 45*a* of left door 41*a* and inner face 45*b* of right door 41*b* are substantially parallel and the correct distance apart (door gap fixture bar 708 sets the gap or distance between the inner faces 45*a*, 45*b*), top face 46*a* of left door 41*a* and top face 46*b* of right door 41*b* are substantially parallel and collinear (top fixture bar 706 of top T door fixture 700*a* contacts top faces 46*a*, 46*b*), and bottom face 47*a* of left door 41*a* and bottom face 47*b* of right door 41*b* are substantially parallel and collinear (top fixture bar 706 of bottom T door fixture 700*b* contacts top faces 47*a*, 47*b*). The clamped together left and right door assemblies 40*a*, 40*b* are then positioned so that top face 46*a* of left door 41*a* and top face 46*b* of right door 41*b* are substantially parallel and collinear with horizontal top wall 18 in step 1006. Also at step 1006, left and right door assemblies 40*a*, 40*b* are centered within cabinet 12 so that inner face 45*a* of left door 41*a* and inner face 45*b* of right door 41*b* are substantially equidistant from the cabinet vertical centerline 13.

Figure 30B:
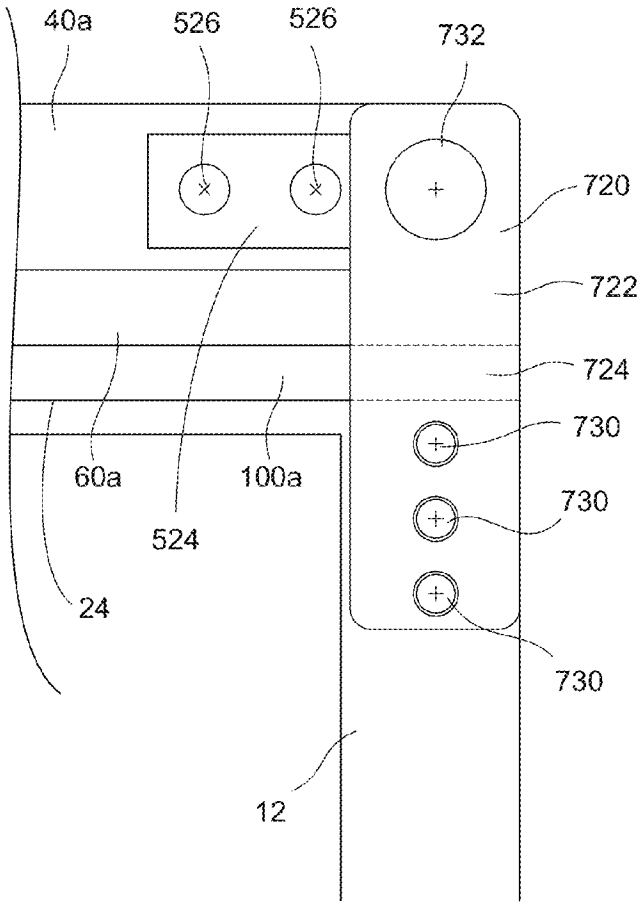
FIG. 30B is a top view of a top left hinge fixture assembly used in one method of installing French doors on a cooler according to one embodiment of the present invention.
Figure 30A:
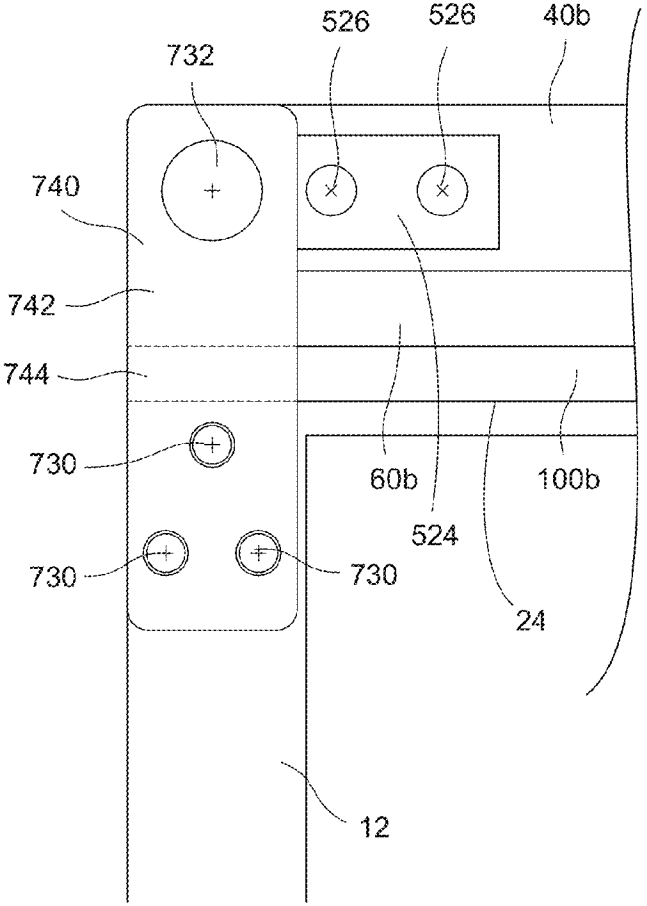
FIG. 30A is a top view of a top right hinge fixture assembly used in one method of installing French doors on a cooler according to one embodiment of the present invention.

Referring again to FIG. 28, following the installation of bottom left and right hinge brackets 550, an adjustable top left hinge assembly 500*a* and a top right hinge assembly 500*b* are installed on cabinet 12 at step 1008. In one particular embodiment, a top left hinge fixture assembly 720 and a top right hinge fixture assembly 740 may be used to pre-drill or otherwise locate where adjustable top left hinge assembly 500*a* and top right hinge assembly 500*b* are to be secured to cabinet 12. As shown in FIG. 30A, locator pin 732 of top right hinge fixture assembly 740 is placed in spring cartridge body 516*b* of top right hinge assembly 500*b* wherein spring and rotatable top portion 517 of spring cartridge assembly 515*b* and top right hinge bracket 511 have been removed from top right hinge assembly 500*b*. With left and right door assemblies 40*a*, 40*b* positioned with top face 46*a* of left door 41*a* and top face 46*b* of right door 41*b* substantially parallel and collinear with horizontal top wall 18 and locator ribs 724 and 744 touching cabinet front face 24 to ensure the proper positioning of left and right door assemblies 40*a*, 40*b* with respect to cabinet front face 24 so that perimeter gaskets 100*a* and 100*b* seal properly, three holes are then drilled into cabinet 12 using drill bushings 730 as a guide. As shown in FIG. 30B, locator pin 732 of top left hinge fixture assembly 720 is placed in spring cartridge body 516*a* of adjustable top left hinge assembly 500*a* wherein spring and rotatable top portion 517 of spring cartridge assembly 515*b* and adjustable top left hinge bracket 501 have been removed from adjustable top left hinge assembly 500*a*. With left and right door assemblies 40*a*, 40*b* positioned with top face 46*a* of left door 41*a* and top face 46*b* of right door 41*b* substantially parallel and collinear with horizontal top wall 18, three holes are then drilled into cabinet 12 using drill bushings 730 as a guide. After the holes for adjustable top left hinge assembly 500*a* and top right hinge assembly 500*b* have been drilled, top left hinge fixture assembly 720 and top right hinge fixture assembly 740 are removed. Then springs and rotatable top portions 517 of spring cartridge assemblies 515*a* and 515*b* are replaced in spring cartridge bodies 516*a* and 516*b*. Hinge pin 506 of adjustable top left hinge bracket 501 is then placed in hinge pin receiving hole 518*a* of spring cartridge assembly 515*a* and spring cartridge engaging pin 505 is inserted into pin engaging slot 520 of spring cartridge assembly 515*a*. Adjustable top left hinge bracket 501 is then secured to cabinet 12 using three pan head screws and internal tooth lock washers. Hinge pin 506 of top right hinge bracket 511 is then placed in hinge pin receiving hole 518*b* of spring cartridge assembly 515*b* and spring cartridge engaging pin 505 is inserted into pin engaging slot 520 of spring cartridge assembly 515*b*. Adjustable top left hinge bracket 511 is then secured to cabinet 12 using three flathead screws. It is to be understood that the holes for adjustable top left hinge assembly 500*a* may be drilled after the holes for top right hinge assembly 500*b* or vice versa without departing from the scope of the present disclosure. Additionally, it is to be understood that adjustable top left hinge assembly 500*a* may be affixed to cabinet after the top right hinge assembly 500*b* or vice versa without departing from the scope of the present disclosure. While specific types of screws and washers are described herein, it is to be understood that any type of screw or type of fastener and that any type of washer may be used to secure adjustable top left hinge assembly 500*a* and top right hinge assembly 500*b* to cabinet 12 without departing from the scope of the present disclosure.

In another embodiment, an adjustable top left hinge assembly 500*a* and a top right hinge assembly 500*b* are already mounted to left and right door assemblies 40*a*, 40*b*, respectively, when left and right door assemblies 40*a*, 40*b* are placed on cabinet 12 in step 1000. In this particular embodiment, the installation of top right hinge assembly 500*b* and adjustable top left hinge assembly 500*a* only encompasses securing top right hinge assembly 500*b* and adjustable top left hinge assembly 500*a* to cabinet 12. In another embodiment, a portion or none of top right hinge assembly 500*b* and adjustable top left hinge assembly 500*b* are mounted to left and right door assemblies 40*a*, 40*b*, respectively, when left and right door assemblies 40*a*, 40*b* are placed on cabinet 12 in step 1000. In this particular embodiment, the installation of top right hinge assembly 500*b* and adjustable top left hinge assembly 500*a* encompasses securing top right hinge assembly 500*b* and adjustable top left hinge assembly 500*a* to left and right door assemblies 40*a*, 40*b*, respectively, and to cabinet 12.

Figure 31:
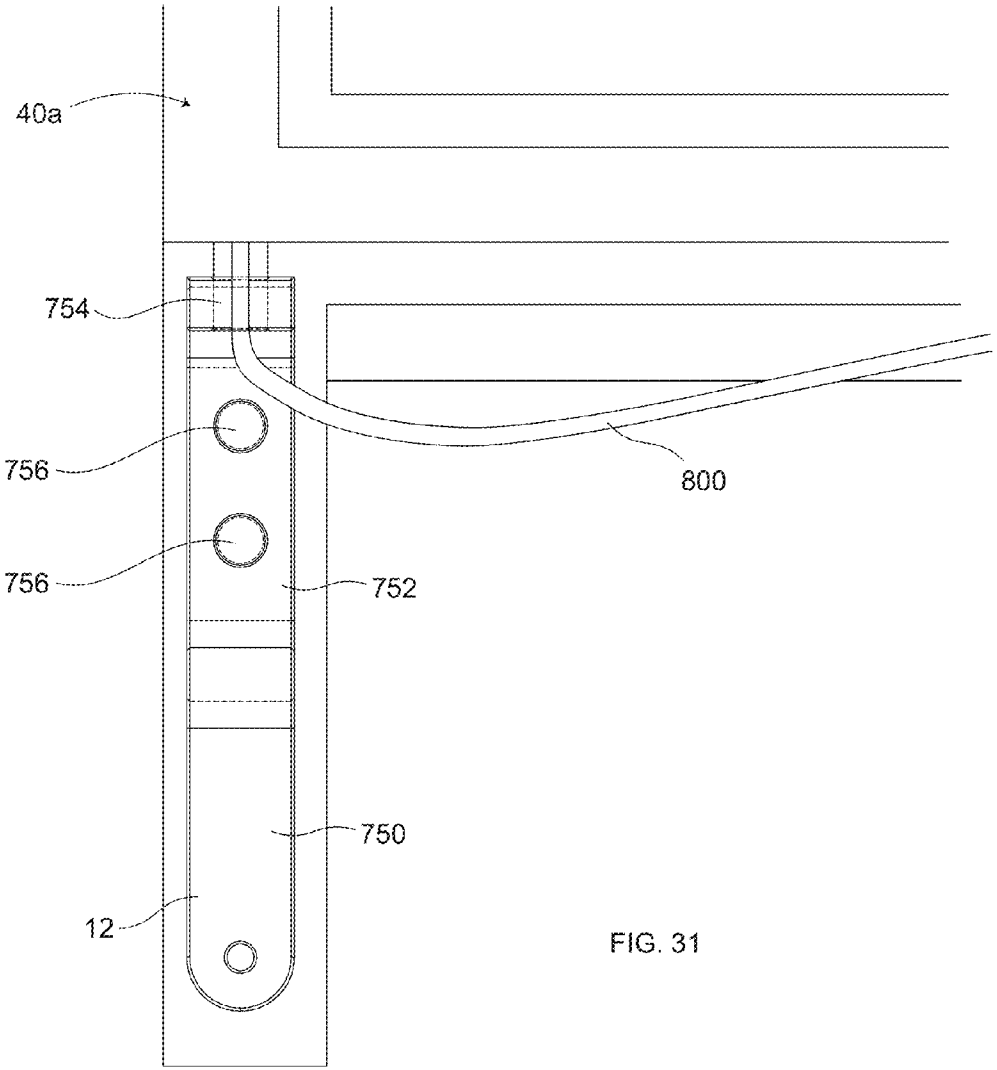
FIG. 31 is a front view of a bottom hinge fixture assembly used in one method of installing French doors on a cooler according to one embodiment of the present invention.

Referring again to FIG. 28, at step 1010, bottom left and right hinge brackets 550 are installed on cabinet 12. In one particular embodiment, bottom hinge fixtures 750 may be used to pre-drill or otherwise locate where bottom left and right hinge brackets 550 are to be secured to cabinet 12. As shown in FIG. 31, bottom hinge fixture 750 is placed at bottom of left door assembly 40*a*, wherein slotted locator pin 754 is placed in a bushing (not shown) in the bottom of left door assembly 40*a*. A wire 800 used to provide power to left and right doors 41*a*, 41*b* (e.g., for lights) is placed inside slotted locator pin. Hole locations are marked using the locations of holes 756, after which bottom hinge fixture 750 may be removed and the marked holes may be drilled. Removing the bottom hinge fixture 750 before drilling the holes, assists in preventing damage to wire 800. After the holes are drilled, a thrust washer (not shown) is placed over a bottom hinge pin (not shown) and the washer and pin are inserted into the bushings (not shown) on the bottom of left and right door assemblies 40*a* and 40*b*. While pushing left and right door assemblies 40*a* and 40*b* toward the adjustable top left hinge assembly 500*a* and the top right hinge assembly 500*b*, bottom left and right hinge brackets 550 are secured to cabinet 12 using screws. In other embodiments, bottom left and right hinge brackets 550 are already mounted to left and right door assemblies 40*a*, 40*b*, respectively, when left and right door assemblies 40*a*, 40*b* are placed on cabinet 12 in step 1000. In this particular embodiment, the installation of bottom left and right hinge brackets 550 only encompasses securing bottom left and right hinge brackets 550 to cabinet 12. In another embodiment, a portion or none of bottom left and right hinge brackets 550 are mounted to left and right door assemblies 40*a*, 40*b*, respectively, when left and right door assemblies 40*a*, 40*b* are placed on cabinet 12 in step 1000. In this particular embodiment, the installation of bottom left and right hinge brackets 550 encompasses securing bottom left and right hinge brackets 550 to left and right door assemblies 40*a*, 40*b*, respectively, and to cabinet 12.

Referring again to FIG. 28, after the hinge assemblies have been installed on cabinet 12 at steps 1008 and 1010, top and bottom T door fixtures 700*a* and 700*b* and clamp 82 are removed at step 1012. Then cabinet 12 is oriented in a substantially vertical position at step 1014 such that cabinet front face 24 is facing substantially horizontal. Then at step 1016, left door assembly 40*a* and right door assembly 40*b* are opened separately and allowed to close on their own (i.e., left door assembly 40*a* is opened and allowed to close, then right door assembly 40*b* is opened and allowed to close). If either the left door assembly 40*a* and/or right door assembly 40*b* do not fully close at step 1018, adjustable top left hinge assembly 500*a* and/or bottom hinge assemblies 550 may be adjusted at step 1020 to ensure that inner face 45*a* of left door 41*a* and inner face 45*b* of right door 41*b* are substantially parallel and the correct distance apart so that the doors will close properly. In one embodiment, a final inspection step may be performed prior to step 1016, wherein a second set of top and bottom T door fixtures are placed between left and right door assemblies 40*a*, 40*b* to check that the spacing between the inner face 45*a* of left door 41*a* and inner face 45*b* of right door 41*b* has not changed during other manufacturing steps. If after step 1018, left and right door assemblies 40*a*, 40*b* close properly, installation of the left and right door assemblies 40*a*, 40*b* may be complete at step 1022.

Although the refrigerator cooler having a number of features, none of these features should be considered critical as the cooler described herein has a number of novel features that may be incorporated either separately or in certain combinations into a cooler. Accordingly, various features of the described refrigerator cooler have been shown and described in connection with the illustrated embodiments. However, it is to be understood that these features are presented herein as being illustrative of the refrigerator cooler, and that the scope of the invention is to be determined by the appended claims.

The invention claimed is:

1. A refrigerator cooler comprising:

(a) a cabinet comprising at least one storage compartment, wherein the compartment has an open front and is bounded by a back wall, a bottom wall, a top wall, a left side wall, and a right side wall, wherein the bottom wall, the top wall, the left side wall, and the right side wall comprise a cabinet front face;

(b) a left door assembly rotatably affixed to the cabinet comprising:

(i) a left door having a back face and an inner face;

(ii) a left perimeter gasket affixed to the back face of the left door, wherein the left perimeter gasket contacts a portion of the cabinet front face when the left door is in the closed position;

(iii) a left magnetic French door gasket assembly affixed to the inner face of the left door, wherein the left magnetic French door gasket assembly is separate from the left perimeter gasket; and (iv) one or more door stops affixed to the left door; and (c) a right door assembly rotatably affixed to the cabinet comprising:

(i) a right door having a back face and an inner face;

(ii) a right perimeter gasket affixed to the back face of the right door, wherein the right perimeter gasket contacts a portion of the cabinet front face when the right door is in the closed position;

(iii) a right magnetic French door gasket assembly affixed to the inner face of the right door, wherein the right magnetic French door gasket assembly is separate from the right perimeter gasket; and (iv) one or more door stops affixed to the right door;

wherein the left and right magnetic French door gasket assemblies each comprise:

a French door gasket comprising:

a top end and a bottom end;

a base portion;

an anterior sealing portion;

a gasket-to-gasket sealing portion;

an anterior tab receiving chamber; and a posterior tab receiving chamber;

a population of magnets within the French door gasket;

a top gasket plug secured to the top end of the French door gasket, wherein the top gasket plug seals the top end of the French door gasket; and a bottom gasket plug secured to the bottom end of the French door gasket, wherein the bottom gasket plug seals the bottom end of the French door gasket;

wherein the top and bottom gasket plugs each comprise anterior and posterior tabs which are adapted to be inserted into the anterior and posterior tab receiving chambers, respectively; and wherein the left and right magnetic French door gasket assemblies are magnetically attracted to one another when the left and right doors are closed and are magnetically opposed to one another when at least one of the left and right doors are opened.

2. The refrigerator cooler of claim 1, wherein the French door gasket further comprises a sealing flange extending from the anterior sealing portion in a direction away from the gasket-to-gasket sealing portion.

3. The refrigerator cooler of claim 2, wherein the sealing flange of the left and right magnetic French door gasket assemblies partially covers the left and right perimeter gaskets, respectively.

4. The refrigerator cooler of claim 3, wherein the sealing flange of the left and right magnetic French door gasket assemblies is disposed between the left and right perimeter gaskets, respectively, and the cabinet front face when at least one of the left and right door assemblies are in the closed positions.

5. The refrigerator cooler of claim 2, wherein the sealing flange is from about ¼ inches wide to about ⅝ inches wide.

6. The refrigerator cooler of claim 2, wherein the sealing flange is about ⅜ inches wide.

7. The refrigerator cooler of claim 1, wherein the French door gasket further comprises first and second darts, wherein the first dart is substantially parallel to the base portion and wherein the second dart is substantially orthogonal to the base portion.

8. The refrigerator cooler of claim 7, wherein at least one of the left and right door assemblies include first and second channels adapted to receive the first and second darts of the left and right magnetic French door gaskets.

9. The refrigerator cooler of claim 1, wherein the anterior and posterior tabs of the top and bottom gasket plugs reduce mushrooming of the French door gasket.

10. A refrigerator cooler comprising:

(a) a cabinet comprising at least one storage compartment, wherein the compartment has an open front and is bounded by a back wall, a bottom wall, a top wall, a left side wall, and a right side wall, wherein the bottom wall, the top wall, the left side wall, and the right side wall comprise a cabinet front face;

(b) a left door assembly rotatablv affixed to the cabinet comprising:

(i) a left door having a back face and an inner face;

(ii) a left perimeter gasket affixed to the back face of the left door, wherein the left perimeter gasket contacts a portion of the cabinet front face when the left door is in the closed position;

(iii) a left magnetic French door gasket assembly affixed to the inner face of the left door, wherein the left magnetic French door gasket assembly is separate from the left perimeter gasket; and (iv) one or more door stops affixed to the left door; and (c) a right door assembly rotatable affixed to the cabinet comprising:

(i) a right door having a back face and an inner face;

(ii) a right perimeter gasket affixed to the back face of the right door, wherein the right perimeter gasket contacts a portion of the cabinet front face when the right door is in the closed position;

(iii) a right magnetic French door gasket assembly affixed to the inner face of the right door, wherein the right magnetic French door gasket assembly is separate from the right perimeter gasket; and (iv) one or more door stops affixed to the right door;

wherein the left and right magnetic French door gasket assemblies each comprise:

a French door gasket comprising:

a top end and a bottom end;

a base portion;

an anterior sealing portion; and a gasket-to-gasket sealing portion;

a population of magnets within the French door gasket, wherein at least one of the population of magnets comprise a first end and a second end, and wherein at least one of the first and second ends include at least one of a miter cut, a center tab, and offset tab(s);

a top gasket plug secured to the top end of the French door gasket, wherein the top gasket plug seals the top end of the French door gasket; and a bottom gasket plug secured to the bottom end of the French door gasket, wherein the bottom gasket plug seals the bottom end of the French door gasket;

wherein at least one of the top and bottom gasket plugs include a population of tabs adapted to interface with at least one of the miter cut, the center tab, and the offset tab(s) of the magnets when the magnets are in the correct orientation in the French door gasket; and wherein the left and right magnetic French door gasket assemblies are magnetically attracted to one another when the left and right doors are closed and are magnetically opposed to one another when at least one of the left and right doors are opened.

11. The refrigerator cooler of claim 10, wherein the French door gasket further comprises a sealing flange extending from the anterior sealing portion in a direction away from the gasket-to-gasket sealing portion.

12. The refrigerator cooler of claim 11, wherein the sealing flange of the left and right magnetic French door gasket assemblies partially covers the left and right perimeter gaskets, respectively.

13. The refrigerator cooler of claim 12, wherein the sealing flange of the left and right magnetic French door gasket assemblies is disposed between the left and right perimeter gaskets, respectively, and the cabinet front face when at least one of the left and right door assemblies are in the closed positions.

14. The refrigerator cooler of claim 11, wherein the sealing flange is from about ¼ inches wide to about ⅝ inches wide.

15. The refrigerator cooler of claim 11, wherein the sealing flange is about ⅜ inches wide.

16. The refrigerator cooler of claim 10, wherein the French door gasket further comprises first and second darts, wherein the first dart is substantially parallel to the base portion and wherein the second dart is substantially orthogonal to the base portion.

17. The refrigerator cooler of claim 16, wherein at least one of the left and right door assemblies include first and second channels adapted to receive the first and second darts of the left and right magnetic French door gaskets.

18. A refrigerator cooler comprising:

(a) a cabinet comprising at least one storage compartment, wherein the compartment has an open front and is bounded by a back wall, a bottom wall, a top wall, a left side wall, and a right side wall, wherein the bottom wall, the top wall, the left side wall, and the right side wall comprise a cabinet front face;

(b) a left door assembly rotatablv affixed to the cabinet comprising:

(i) a left door having a back face and an inner face;

(ii) a left perimeter gasket affixed to the back face of the left door, wherein the left perimeter gasket contacts a portion of the cabinet front face when the left door is in the closed position;

(iii) a left magnetic French door gasket assembly affixed to the inner face of the left door, wherein the left magnetic French door gasket assembly is separate from the left perimeter gasket; and (iv) one or more door stops affixed to the left door; and (c) a right door assembly rotatable affixed to the cabinet comprising:

(i) a right door having a back face and an inner face;

(ii) a right perimeter gasket affixed to the back face of the right door, wherein the right perimeter gasket contacts a portion of the cabinet front face when the right door is in the closed position;

(iii) a right magnetic French door gasket assembly affixed to the inner face of the right door, wherein the right magnetic French door gasket assembly is separate from the right perimeter gasket; and (iv) one or more door stops affixed to the right door;

wherein the left and right magnetic French door gasket assemblies each comprise:

a French door gasket comprising:

a top end and a bottom end;

a base portion;

an anterior sealing portion; and a gasket-to-gasket sealing portion;

a population of magnets within the French door gasket;

a top gasket plug secured to the top end of the French door gasket, wherein the top gasket plug seals the top end of the French door gasket; and a bottom gasket plug secured to the bottom end of the French door gasket, wherein the bottom gasket plug seals the bottom end of the French door gasket;

wherein one or more of the top and bottom gasket plugs include a marking which assists in correctly orienting the left and right magnetic French door gasket assemblies on the left and right door assemblies, respectively; and wherein the left and right magnetic French door gasket assemblies are magnetically attracted to one another when the left and right doors are closed and are magnetically opposed to one another when at least one of the left and right doors are opened.

19. The refrigerator cooler of claim 18, wherein the French door gasket further comprises a sealing flange extending from the anterior sealing portion in a direction away from the gasket-to-gasket sealing portion.

20. The refrigerator cooler of claim 19, wherein the sealing flange of the left and right magnetic French door gasket assemblies partially covers the left and right perimeter gaskets, respectively.

21. The refrigerator cooler of claim 20, wherein the sealing flange of the left and right magnetic French door gasket assemblies is disposed between the left and right perimeter gaskets, respectively, and the cabinet front face when at least one of the left and right door assemblies are in the closed positions.

22. The refrigerator cooler of claim 19, wherein the sealing flange is from about ¼ inches wide to about ⅝ inches wide.

23. The refrigerator cooler of claim 19, wherein the sealing flange is about ⅜ inches wide.

24. The refrigerator cooler of claim 18, wherein the French door gasket further comprises first and second darts, wherein the first dart is substantially parallel to the base portion and wherein the second dart is substantially orthogonal to the base portion.

25. The refrigerator cooler of claim 24, wherein at least one of the left and right door assemblies include first and second channels adapted to receive the first and second darts of the left and right magnetic French door gaskets.

* * * * *

UNITED STATES PATENT AND TRADEMARK OFFICE

CERTIFICATE OF CORRECTION

PATENT NO. : 9,052,135 B2
APPLICATION NO. : 13/972353
DATED : June 9, 2015
INVENTOR(S) : Steven L. Trulaske, Sr.

It is certified that error appears in the above-identified patent and that said Letters Patent is hereby corrected as shown below:

In the Claims:

Column 25, line 5, in claim 10, delete “rotatablv” and insert --“rotatably”--.

Column 25, line 17, in claim 10, delete “rotatable” and insert --“rotatably”--.

Column 26, line 24, in claim 18, delete “rotatablv” and insert --“rotatably”--.

Column 26, line 36, in claim 18, delete “rotatable” and insert --“rotatably”--.

Signed and Sealed this
Twentieth Day of October, 2015

Michelle K. Lee

Michelle K. Lee
*Director of the United States Patent and Trademark Office*